US012345172B2

(12) United States Patent
Ji et al.

(10) Patent No.: US 12,345,172 B2
(45) Date of Patent: Jul. 1, 2025

(54) FRACTURING DEVICE, ENGINE AND EXHAUST APPARATUS THEREOF

(71) Applicant: YANTAI JEREH PETROLEUM EQUIPMENT & TECHNOLOGIES CO., LTD., Shandong (CN)

(72) Inventors: Xiaolei Ji, Shandong (CN); Junlong Du, Shandong (CN); Rikui Zhang, Shandong (CN); Peng Zhang, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 0 days.

(21) Appl. No.: 18/347,346

(22) Filed: Jul. 5, 2023

(65) Prior Publication Data

US 2023/0374916 A1 Nov. 23, 2023

Related U.S. Application Data

(63) Continuation-in-part of application No. 17/900,348, filed on Aug. 31, 2022, which is a continuation of (Continued)

(30) Foreign Application Priority Data

Dec. 2, 2020 (CN) ..... 202022891295.X
Sep. 29, 2022 (CN) ..... 202211199070.5

(51) Int. Cl.
*F01N 13/08* (2010.01)
*F01D 25/30* (2006.01)
(Continued)

(52) U.S. Cl.
CPC ..... *F01D 25/30* (2013.01); *E21B 43/2607* (2020.05)

(58) Field of Classification Search
CPC ..... F01D 25/30; B64F 1/26; B64D 33/06; B64D 33/04; E21B 43/2607; F02C 7/24;
(Continued)

(56) References Cited

U.S. PATENT DOCUMENTS 2,350,102 A 5/1944 Fairbanks
3,446,010 A * 5/1969 Hopkins ..... F01N 13/085 55/417

(Continued)

FOREIGN PATENT DOCUMENTS

CN 203485181 U 3/2014
CN 106122669 A 11/2016

(Continued)

OTHER PUBLICATIONS

International Search Report mailed Aug. 4, 2021 for International Application No. PCT/CN2021/074180, including English translation.

(Continued)

*Primary Examiner* — Edgardo San Martin
(74) *Attorney, Agent, or Firm* — Crowell & Moring LLP

(57) ABSTRACT

This application discloses a fracturing device, an engine and an exhaust apparatus thereof, which belongs to the field of turbine fracturing technologies. The engine is provided with a first exhaust outlet, and the exhaust apparatus of the engine includes an exhaust muffler, a shroud plate and a cover plate, where the exhaust muffler is provided at a first exhaust outlet, the exhaust muffler is provided with a second exhaust outlet, and the shroud plate is provided at the second exhaust outlet, the shroud plate is movably connected to the exhaust muffler, the shroud plate can move between a first position and a second position relative to the exhaust muffler, and the cover plate is rotationally connected to the exhaust muffler to close or open the second exhaust outlet. In a case that the (Continued)

shroud plate moves to the first position relative to the exhaust muffler and the cover plate opens the second exhaust outlet, the shroud plate and cover plate form a heightening tube. The heightening tube communicates with the second exhaust outlet, and the position of an upper port of the heightening tube is higher than the position of the second exhaust outlet. The engine includes the exhaust apparatus mentioned above, and the fracturing device includes the engine mentioned above. As such, reducing the number of components is facilitated, and the structure is simplified.

12 Claims, 21 Drawing Sheets

Related U.S. Application Data application No. PCT/CN2021/074180, filed on Jan. 28, 2021.

(51) Int. Cl.
*F02C 7/24* (2006.01)
*E21B 43/26* (2006.01)

(58) Field of Classification Search
CPC . F05D 2260/96; F16L 55/115; F16L 55/1155; F16L 55/1157; F01N 13/085; F01N 13/08; F01N 13/002; F01N 2309/08; F01N 2590/10
See application file for complete search history.

(56) References Cited

U.S. PATENT DOCUMENTS

| | | | | |
|---|---|---|---|---|
| 3,960,063 | A | 6/1976 | Siemes | |
| 4,106,290 | A * | 8/1978 | Johnson | F01N 13/085 60/324 |
| 5,213,157 | A | 5/1993 | Wills | |
| 5,428,957 | A * | 7/1995 | Keates | F01N 13/08 454/94 |
| 5,876,282 | A | 3/1999 | Kenny | |
| 6,457,550 | B1 | 10/2002 | Barry | |
| 8,534,235 | B2 | 9/2013 | Chandler | |
| 8,960,564 | B2 | 2/2015 | Chandler | |
| 10,954,855 | B1 | 3/2021 | Ji | |
| 10,961,914 | B1 | 3/2021 | Yeung | |
| 10,961,993 | B1 | 3/2021 | Ji | |
| 11,105,250 | B1 * | 8/2021 | Zhang | E21B 43/2607 |
| 11,242,802 | B2 * | 2/2022 | Yeung | F02C 6/00 |
| 11,459,954 | B2 | 10/2022 | Yeung et al. | |
| 2008/0282690 | A1 | 11/2008 | Ikeda | |
| 2010/0200792 | A1 | 8/2010 | Ikeda | |
| 2014/0048268 | A1 | 2/2014 | Chandler | |
| 2023/0374916 | A1 | 11/2023 | Ji et al. | |
| 2024/0167396 | A1 * | 5/2024 | Rodriguez-Ramon | E21B 43/2607 |

FOREIGN PATENT DOCUMENTS

| | | | |
|---|---|---|---|
| CN | 206429802 | U | 8/2017 |
| CN | 209594406 | U | 11/2019 |
| CN | 209801485 | U | 12/2019 |
| CN | 210462142 | U | 5/2020 |
| CN | 111867334 | A | 10/2020 |
| CN | 211819660 | U | 10/2020 |
| CN | 211885843 | U | 11/2020 |
| CN | 214887012 | U | 11/2021 |
| DE | 3044286 | A1 | 6/1982 |
| FR | 2 388 963 | A1 | 11/1978 |
| WO | WO 2022/116387 | A1 | 6/2022 |

OTHER PUBLICATIONS

Written Opinion mailed Aug. 4, 2021 for International Application No. PCT/CN2021/074180.
Office Action issued in related U.S. Appl. No. 17/900,348 dated Sep. 16, 2024, 6 pages.
Chinese-language Office Action issued in Chinese Application No. 202211199070.5 dated Mar. 31, 2025 with English translation (17 pages).

* cited by examiner

FRACTURING DEVICE, ENGINE AND EXHAUST APPARATUS THEREOF

CROSS REFERENCE

This application is based on and claims the benefit of priority to Chinese Patent Application No. 202211199070.5, filed on Sep. 29, 2022. This application is further based on and claims the benefit of priority to U.S. patent application Ser. No. 17/900,348 filed on Aug. 31, 2022, which is based on and claims the benefit of priority to PCT Application No. PCT/CN2021/074180, filed on Jan. 28, 2021, which is based on and claims the benefit of priority to Chinese Patent Application No. 202022891295.X, filed on Dec. 2, 2020. These prior patent applications are hereby incorporated by reference in their entireties.

TECHNICAL FIELD

This application belongs to the field of turbine fracturing technologies, and particularly relates to a fracturing device, an engine and an exhaust apparatus thereof.

BACKGROUND

In the field of turbo fracturing, an exhaust outlet of an engine is usually equipped with an exhaust muffler. The exhaust muffler leads out exhaust from the engine and reduces noise in the gas discharge process. Moreover, the exhaust muffler is usually equipped with a rain cap, and the rain cap can seal an exhaust outlet of the exhaust muffler, preventing foreign objects such as external rainwater or sand from entering the exhaust muffler, thereby avoiding that the foreign objects enter the engine for fear of influencing the engine.

In the related art, the height difference between the exhaust outlet of the exhaust muffler and a mounting surface where the engine is provided is relatively small, that is, the height of the exhaust outlet of the exhaust muffler is relatively low, so that the noise generated after an exhaust gas from the engine passes through the exhaust muffler is still relatively high, and the effect of reducing the noise is relatively poor. To improve the noise reduction effect, the exhaust outlet of the exhaust muffler can be provided with a heightening apparatus. The exhaust height is increased by the heightening apparatus, thereby reducing the noise. However, the exhaust apparatus requires both the heightening apparatus and the rain cap (or rain cover) to be provided, thereby resulting in that the number of components is relatively large and the structure is complex. Traditionally, a rain cover may be fixed on the exhaust muffler via bolts. When the turbine is not in operation, the rain cover may be in a closed state and thereby prevents rainwater from entering the exhaust muffler. The rain cover on the conventional exhaust muffler may be in a form of a single cover plate, and is usually controlled to open or close driven by an electrical winch. The arrangement of conventional rain cover might cause the following problems with the exhaust muffler:

1. Insufficient safety factor: in an unoperated state, the conventional single-cover plate exhaust muffler cannot properly shield/cover the opening of the exhaust muffler. There is still a risk that rainwater, dusts and debris may enter the turbine engine. Debris might still deposit in the interior of the exhaust muffler, which affects the water-draining function;
2. High noise: due to limitations from road regulations, the height of the conventional exhaust muffler might not be enough, so the exhaust gas after passing through the exhaust muffler is noisy;
3. Unreasonable structure: as the height of the exhaust muffler might not be enough, the exhaust gas cannot be led to an high enough level, so the exhaust gas might be sucked back by the turbine engine intake system again, which reduces the lifetime of the turbine engine.

Therefore, it is desirable to provide a rain cover assembly, a pipe assembly and a turbine fracturing unit to at least partially solve the above-mentioned problems. The rain cover assembly provided by the present disclosure is not limited to the use for the above-mentioned turbine fracturing unit, but may be applied to a variety of pipes with openings. The pipe assembly provided by the present invention may also be applied to a variety of power machines/equipment.

SUMMARY

An objective of embodiments of this application provides a fracturing device, an engine and an exhaust apparatus thereof, which can solve the problem that the structure of an exhaust apparatus in the related art is relatively complex.

In a first aspect, the embodiments of this application provide an exhaust apparatus of an engine, the engine being provided with a first exhaust outlet, and the exhaust apparatus including an exhaust muffler, a shroud plate and a cover plate, where:

the exhaust muffler is provided at the first exhaust outlet, and the exhaust muffler is provided with a second exhaust outlet, the shroud plate is provided at the second exhaust outlet, the shroud plate is movably connected to the exhaust muffler, the shroud plate can move between a first position and a second position relative to the exhaust muffler, and the cover plate is rotationally connected to the exhaust muffler to close or open the second exhaust outlet, in a case that the shroud plate moves to the first position relative to the exhaust muffler and the cover plate opens the second exhaust outlet, the shroud plate and the cover plate form a heightening tube, the heightening tube communicates with the second exhaust outlet, and the position of an upper port of the heightening tube is higher than the position of the second exhaust outlet.

In a second aspect, the embodiments of this application provide an engine, including the exhaust apparatus mentioned above.

In a third aspect, the embodiments of this application provide a fracturing device, including the engine mentioned above.

In this embodiment of this application, the cover plate can serve as a rain cap. When the engine is in a non-operating state, the cover plate closes the second exhaust outlet to avoid that external foreign objects enter the engine through the exhaust outlet. At the same time, the cover plate can also serve as a part of the heightening tube. When the second exhaust outlet is opened, the cover plate is in fit with the shroud plate to form the heightening tube to increase the exhaust height of the exhaust apparatus, reduce noise generated after an exhaust gas from the engine passes through the exhaust muffler and improve the noise reduction effect. As such, the cover plate can be used for both purposes, without providing the heightening tube and the rain cap separately, which is conducive to reducing the number of components in the exhaust apparatus and simplifying the structure.

BRIEF DESCRIPTION OF THE DRAWINGS

Reference may be made to preferred embodiments shown in the figures to enable better understanding of the above and other objects, features, advantages and functions of the present disclosure. The same reference numerals in the figures denote the same parts. Those having ordinary skill in the art should appreciate that the figures are intended to schematically illustrate example embodiments of the present disclosure, and not intended to impose any limitations to the scope of the present disclosure. Some or all parts in the figures may not be drawn to scale.

REFERENCE NUMERALS

Figure 1:
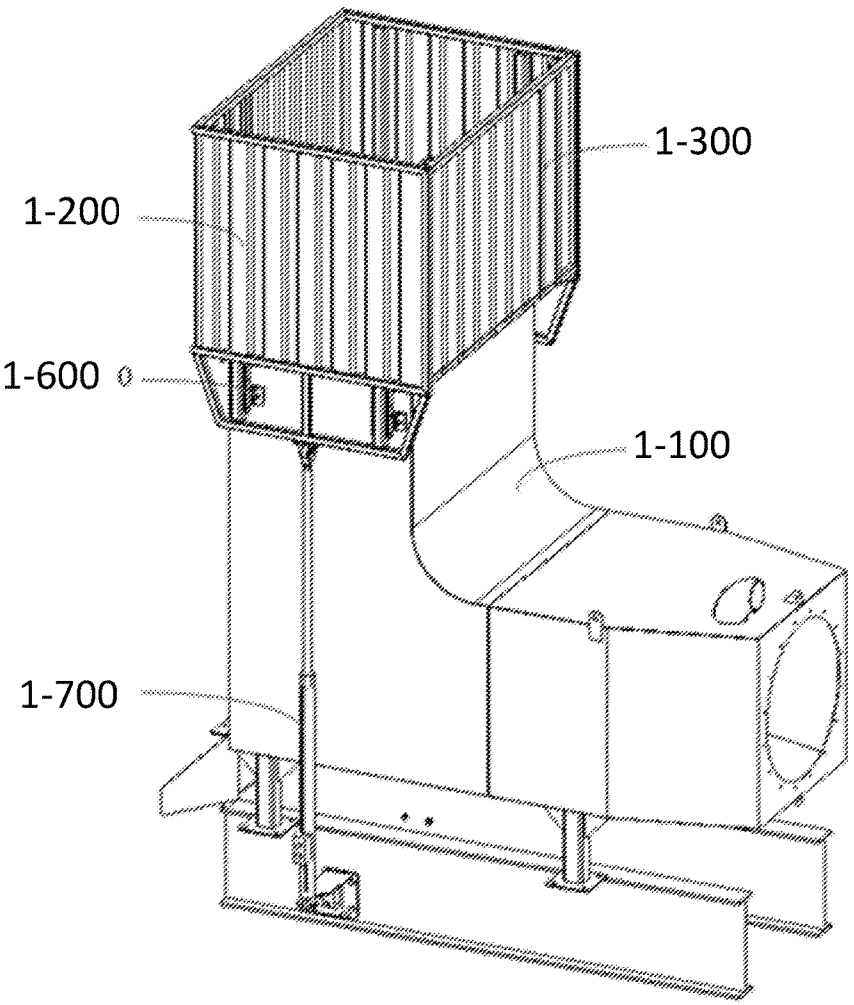
FIG. 1 is a schematic structural diagram of an exhaust apparatus of an engine in a case that a shroud plate is located in a first position according to an embodiment of this application.
Figure 2:
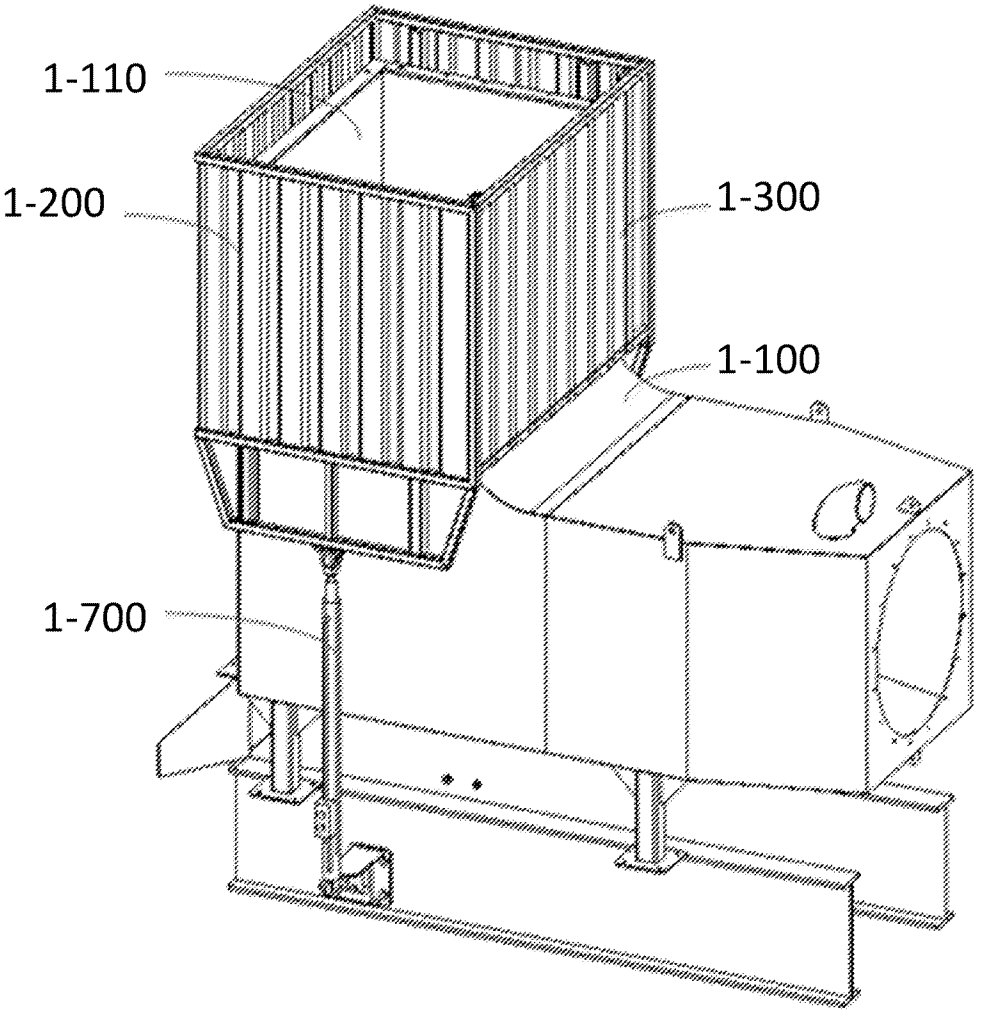
FIG. 2 is a schematic structural diagram of an exhaust apparatus of an engine in a case that a shroud plate is located in a second position according to an embodiment of this application.

1-100—exhaust muffler, 1-110—second exhaust outlet
1-200—shroud plate, 1-210—first enclosure portion, 1-220—second enclosure portion, 1-230—third enclosure portion,
1-300—cover plate,
1-400—connecting rod,
1-510—limit sensor, 1-520—induction piece,
1-600—guide mechanism, 1-610—guide rail, 1-620—sliding piece, 1-630—lubrication plate,
1-700—drive mechanism,
100, 700 Rain cover assembly,
1, 83, 84 Cover plate,
11 Intermediate plate,
12, 831, 841 Side plates,
2 Driving device,
21 Power mechanism,
22 Transmission mechanism,
222 Forced ear,
223 Second pin,
2211 First rod portion,
2212 Second rod portion,
231 Support rod,
232 Hydraulic rod ear,
233 Second pivot,
234 Clamp plate,
235 First pivot,
236 Hydraulic cylinder,
237 Hydraulic lever,
3 Locking device,
4 Connecting member,
41 Base,
42 Pivoting portion,
43 First pin,
411 Base plate,
412 Ear,
4121 Pivot mounting hole,
413 Limiting portion,
4131 Extension plate,
4132 Limiting plate,
5 Baffle,
200, 800 Pipe,
300 Mounting plate,
400 Control device,
500 Position sensor,
600 Turbine engine,
601 Diffuser duct,
71, 81 First cover,
72, 82 Second cover,
73 Additional locking device,
731 Mounting plate,
732 Ejector rod,
733 Magnet,
734 U-shaped pressing plate,
7311 Arcuate segment,
851 Pipe-shaped structure,
852 Covering plate,
852*a* One end of the covering plate,

852*b* The other end of the covering plate, and
853 Articulation lever.

DETAILED DESCRIPTION

The technical solution in the embodiments of this application will be described hereinafter in combination with the accompanying drawings in the embodiments of this application. The embodiments provided below are merely examples. All other embodiments obtained by an ordinary person having ordinary skill in the art based on the embodiments of this application shall fall within the protection scope of this application.

The terms "first" and "second" in description and claims of this application are used to distinguish similar objects, but not to describe a specific order or sequence. It is to be understood that data used in this way can be interchanged where appropriate, so that the embodiments of this application can be implemented in order other than those illustrated or described here, and the objects distinguished by "first", "second" and so on are usually of one type, without limiting the number of the objects, for example, the first object may be one or more. Furthermore, "and/or" in description and claims indicates at least one of the connected objects, and the character "I" generally indicates that the associated objects show an "or" relationship.

The fracturing device, the engine and the exhaust apparatus thereof provided by the embodiments of this application will be described in detail through specific embodiments and application scenarios in combination with the accompanying drawings.

Refer to FIG. 1 to FIG. 8, the embodiments of this application disclose an exhaust apparatus of an engine. The engine is provided with a first exhaust outlet. The exhaust apparatus includes an exhaust muffler 1-100, a shroud plate 1-200 and a cover plate 1-300, where the exhaust muffler 1-100 is provided at the first exhaust outlet to allow the exhaust of the engine to enter the exhaust muffler 1-100 through the first exhaust outlet, and to be further discharged through the exhaust muffler 1-100. The exhaust muffler 1-100 is provided with a second exhaust outlet 1-110. The shroud plate 1-200 is provided at the second exhaust outlet 1-110. The shroud plate 1-200 is movably connected to the exhaust muffler 1-100, and the shroud plate 1-200 can move between a first position and a second position relative to the exhaust muffler 1-100. The second exhaust outlet 1-110 may be a square port or a circular port, and the structure of the second exhaust outlet 1-110 is not limited herein. Optionally, the shroud plate 1-200 can be connected to the exhaust muffler 1-100 in a sliding manner or can be rotationally connected to the exhaust muffler 1-100. In short, at least a part of the shroud plate 1-200 can move to the upper portion of the second exhaust outlet 1-110 to form a heightening tube. The cover plate 1-300 is rotationally connected to the exhaust muffler 1-100 to close or open the second exhaust outlet 1-110. Optionally, the cover plate 1-300 is rotationally connected to the edge of the second exhaust outlet 1-110 of the exhaust muffler 1-100 through a hinge structure, or through other structures. In a case that the cover plate 1-300 opens the second exhaust outlet 1-110, a plane where the cover plate 1-300 is located can be parallel to the orientation of the second exhaust outlet 1-110.

As shown in FIG. 1, in a case that the shroud plate 1-200 moves to the first position relative to the exhaust muffler 1-100 and the cover plate 1-300 opens the second exhaust outlet 1-110, at least a part of the shroud plate 1-200 is located above the second exhaust outlet 1-110 at this time, and the plane where the cover plate 1-300 is located is parallel to the orientation of the second exhaust outlet 1-110. The shroud plate 1-200 and the cover plate 1-300 form the heightening tube, the heightening tube communicates with the second exhaust outlet 1-110, and the position of an upper port of the heightening tube is higher than the position of the second exhaust outlet 1-110. It is to be noted that the heightening tube formed at this time is an axially closed structure. As such, the exhaust of the engine passes through the exhaust muffler 1-100 and the heightening tube in sequence, and finally is discharged through the upper port of the heightening tube.

In this embodiment of this application, the cover plate 1-300 can serve as a rain cap. When the engine is in a non-operating state, the cover plate 1-300 closes the second exhaust outlet 1-110 to avoid that external foreign objects enter the engine through the exhaust outlet. At the same time, the cover plate 1-300 can also serve as a part of the heightening tube. When the second exhaust outlet 1-110 is opened, the cover plate 1-300 is in fit with the shroud plate 1-200 to form the heightening tube to increase the exhaust height of the exhaust apparatus, reduce noise generated after an exhaust gas from the engine passes through the exhaust muffler 1-100 and improve the noise reduction effect. As such, the cover plate 1-300 can be used for both purposes, without providing the heightening tube and the rain cap separately, which is conducive to reducing the number of components in the exhaust apparatus and simplifying the structure.

Moreover, through the movement of the shroud plate 1-200 relative to the exhaust muffler 1-100, the height of the shroud plate 1-200 can be changed. Therefore, when the cover plate 1-300 closes the second exhaust outlet 1-110, the height of the shroud plate 1-200 can be reduced to reduce the overall height of the exhaust apparatus, reduce the occupied space and facilitate transportation.

Figure 3:
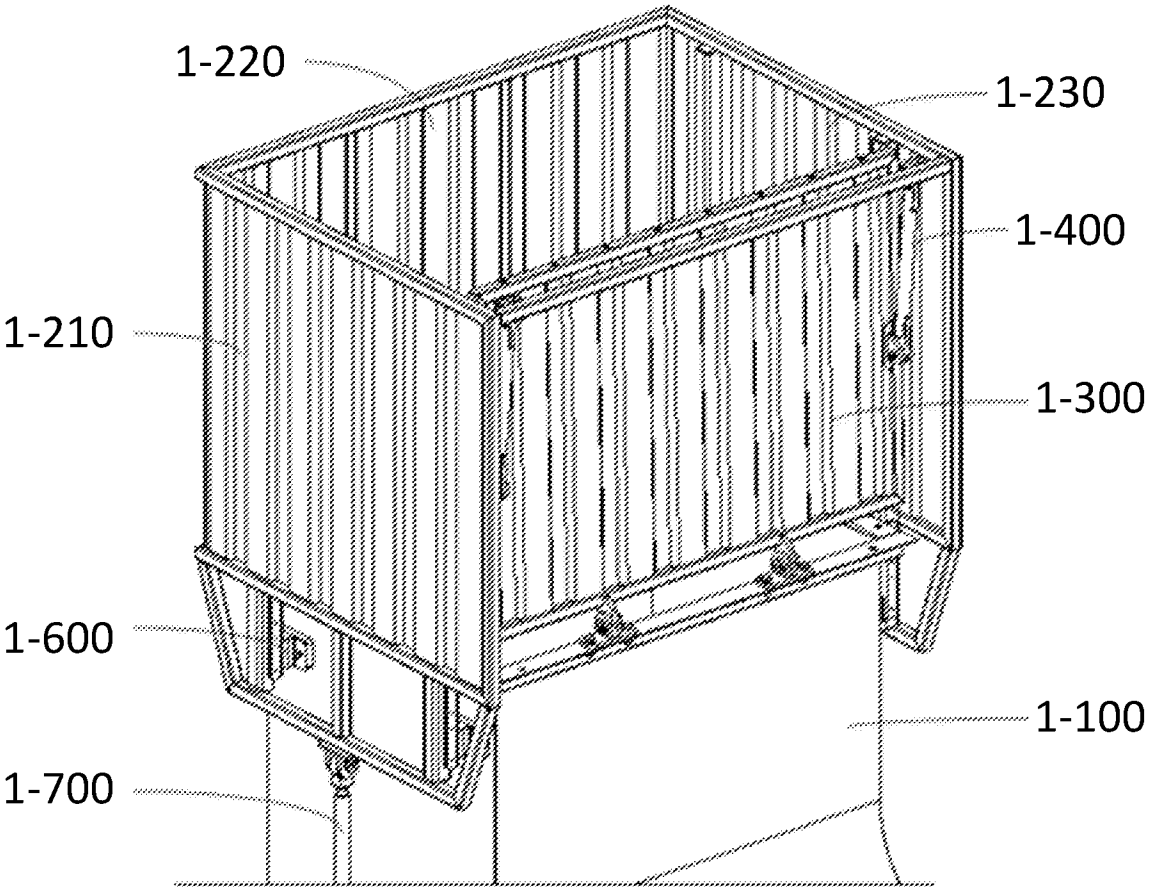
FIG. 3 is a partial schematic structural diagram of an exhaust apparatus of an engine in a case that a shroud plate is located in a first position according to an embodiment of this application.

In an optional embodiment, in a case that the shroud plate 1-200 moves to the first position relative to the exhaust muffler 1-100, the top surface of the shroud plate 1-200 is higher than the top surface of the cover plate 1-300, or the top surface of the shroud plate 1-200 is lower than the top surface of the cover plate 1-300. In another embodiment, as shown in FIG. 1 and FIG. 3, in a case that the shroud plate 1-200 moves to the first position relative to the exhaust muffler 1-100, the top surface of the shroud plate 1-200 is flush with the top surface of the cover plate 1-300. As such, the heightening tube is formed by making full use of the whole of the shroud plate 1-200 and the whole of the cover plate 1-300, which can effectively increase the exhaust height. This not only avoids a case that a part of the shroud plate 1-200 is unable to participate in the formation of the heightening tube due to the fact that the top surface of the shroud plate 1-200 is higher than the top surface of the cover plate 1-300, but also avoids the problem that the exhaust height is still relatively small when the top surface of the shroud plate 1-200 is lower than the top surface of the cover plate 1-300.

Optionally, in a case that the shroud plate 1-200 moves to the second position relative to the exhaust muffler 1-100, the shroud plate 1-200 encloses an exhaust end of the exhaust muffler 1-100, and the shroud plate 1-200 is fitted with the outer wall of the exhaust end. As such, the occupied space of the shroud plate 1-200 can be reduced to avoid that the shroud plate 1-200 occupies excess space except for the exhaust muffler 1-100, which is conducive to reducing the occupied space of the exhaust apparatus, so that the structure is more compact and transportation of the exhaust apparatus is facilitated.

In an optional embodiment, the exhaust apparatus may include a drive source, and the drive source is connected to the cover plate 1-300 to drive the cover plate 1-300 to rotate. Optionally, the drive source may be a telescopic cylinder, where one end of the telescopic cylinder is hinged with the cover plate 1-300, and the other end of the telescopic cylinder can be hinged with the exhaust muffler 1-100. The cover plate 1-300 is driven by the telescopic movement of the telescopic cylinder to rotate. In another embodiment, the cover plate 1-300 is movably connected to the shroud plate 1-200, and when the shroud plate 1-200 moves, the cover plate 1-300 is driven to rotate relative to the second exhaust outlet 1-110. In a case that the shroud plate 1-200 moves to the first position relative to the exhaust muffler 1-100, the cover plate 1-300 opens the second exhaust outlet 1-110. At this time, the shroud plate 1-200 is in fit with the cover plate 1-300 to form the heightening tube. In a case that the shroud plate 1-200 moves to the second position relative to the exhaust muffler 1-100, the cover plate 1-300 closes the second exhaust outlet 1-110, and the second exhaust outlet 1-110 is in a closed state. Using this embodiment, when the shroud plate 1-200 moves, the cover plate 1-300 is directly driven to rotate to a suitable position, without a separate drive source to drive the cover plate 1-300 to rotate, which helps to save energy.

In an optional embodiment, the shroud plate 1-200 is rotationally connected to the exhaust muffler 1-100, and when the shroud plate 1-200 rotates, the cover plate 1-300 is driven by a transmission mechanism to rotate. Optionally, a first transmission shaft can be provided at the rotational connection of the shroud plate 1-200 and the exhaust muffler 1-100, a second transmission shaft can be provided at the rotational connection of the cover plate 1-300 and the exhaust muffler 1-100, and the first transmission shaft and the second transmission shaft can be in transmission connection through a bevel gear or other structures. In short, when the shroud plate 1-200 rotates, the first transmission shaft is driven to rotate, thereby driving the second transmission shaft and the cover plate 1-300 to rotate.

Figure 4:
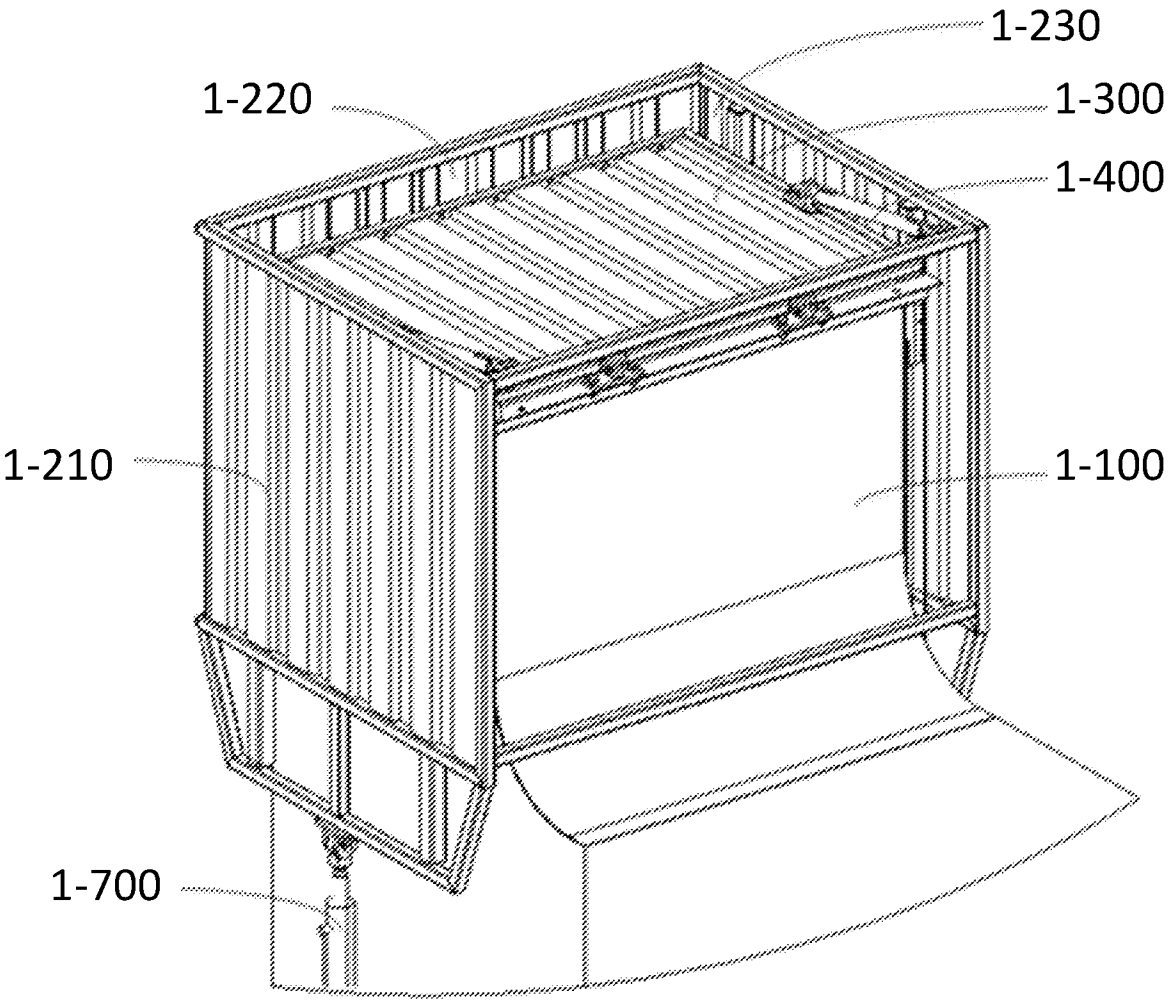
FIG. 4 is a partial schematic structural diagram of an exhaust apparatus of an engine in a case that a shroud plate is located in a second position according to an embodiment of this application.
Figure 5:
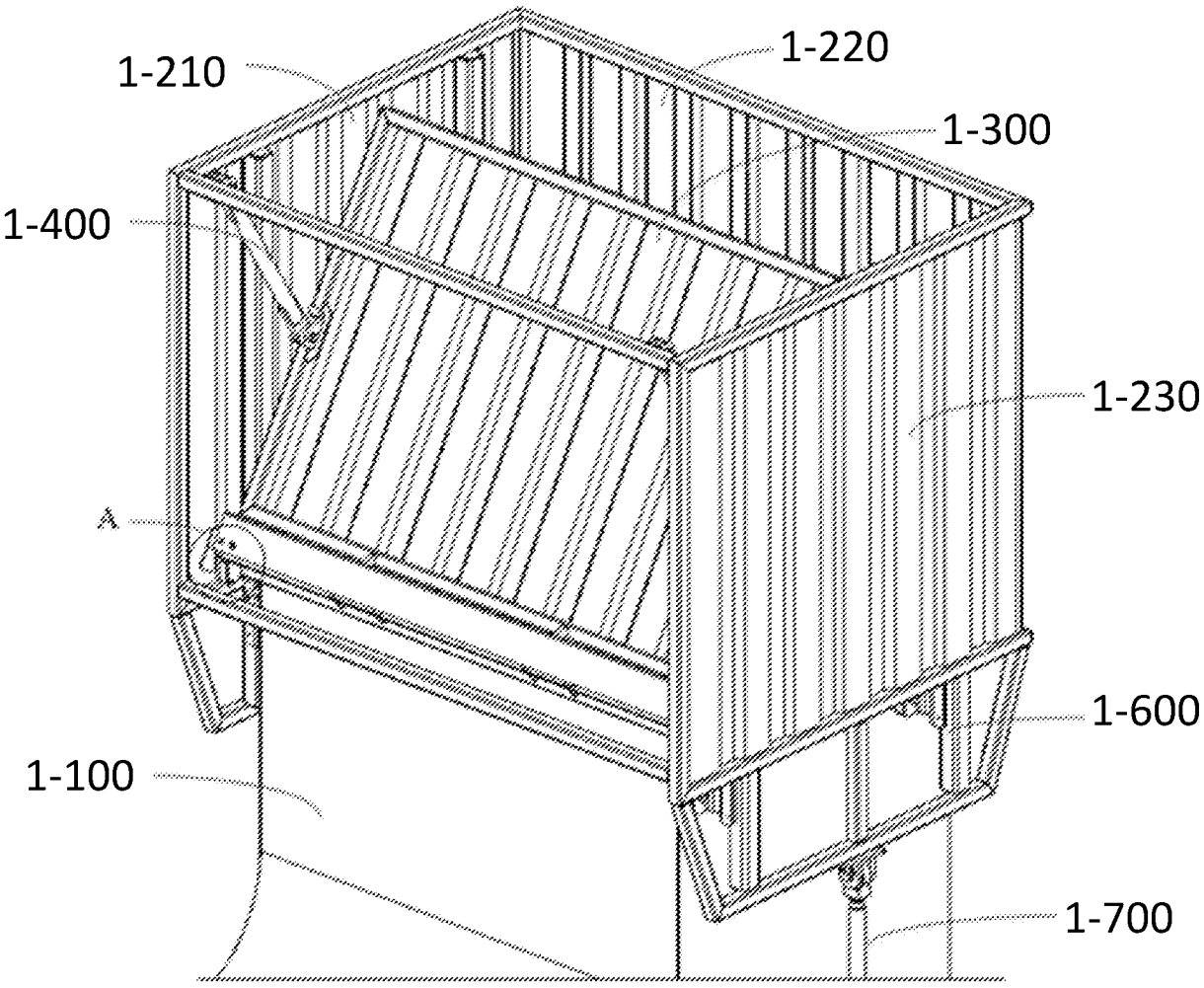
FIG. 5 is a partial schematic structural diagram of an exhaust apparatus of an engine in a case that a shroud plate is located between a first position and a second position according to an embodiment of this application.

In another embodiment, as shown in FIG. 3 to FIG. 5 together, the shroud plate 1-200 (including 1-210, 1-220 and 1-230) is connected to the exhaust muffler 1-100 in a sliding manner. Optionally, the shroud plate 1-200 can rise and fall relative to the second exhaust outlet 1-110. In the process of the movement of the shroud plate 1-200 from the second position to the first position, the shroud plate 1-200 rises, and in the process of the movement of the shroud plate 1-200 from the first position to the second position, the shroud plate 1-200 falls. The exhaust apparatus further includes a connecting rod 1-400. The first end of the connecting rod 1-400 is hinged with the cover plate 1-300, and the second end of the connecting rod 1-400 is hinged with the shroud plate 1-200. When the shroud plate 1-200 slides relative to the exhaust muffler 1-100, the cover plate 1-300 is driven by the connecting rod 1-400 to rotate relative to the second exhaust outlet 1-110. Optionally, the edge of the second exhaust outlet 1-110 is fixedly provided with a base, the lower edge of the cover plate 1-300 is hinged with the base, and one end of the connecting rod 1-400 is hinged with the cover plate 1-300. Therefore, the end of the connecting rod 1-400 that is hinged with the cover plate 1-300 can rotate around a hinge point between the cover plate 1-300 and the base, the other end of the connecting rod 1-400 is hinged with the shroud plate 1-200, and the shroud plate 1-200 can slide relative to the exhaust muffler 1-100. Therefore, the other end of the connecting rod 400 can also slide relative to the exhaust muffler 1-100. As such, the cover plate 1-300, the connecting rod 1-400 and the shroud plate 1-200 form a crank sliding block mechanism. The shroud plate 1-200 serves as a sliding block of the crank sliding block mechanism, and the cover plate 1-300 serves as a crank of the crank sliding block mechanism. Therefore, the shroud plate 1-200 can drive the cover plate 1-300 only through the connecting rod 1-400 to rotate, and the number of transmission components is reduced, so that the connection structure between the shroud plate 1-200 and the cover plate 1-300 is simple, which is conducive to simplifying the structure of the exhaust apparatus.

In an optional embodiment, one connecting rod 1-400 can be provided. In another embodiment, the shroud plate 1-200 is a bent plate. The shroud plate 1-200 includes a first enclosure portion 1-210, a second enclosure portion 1-220 and a third enclosure portion 1-230. The first enclosure portion 1-210, the second enclosure portion 1-220, the third enclosure portion 1-230 and the cover plate 1-300 are sequentially connected end to end. Optionally, the first enclosure portion 1-210, the second enclosure portion 1-220 and the third enclosure portion 1-230 can be of an integrated structure. Side edges of the cover plate 1-300 include a left side edge and a right side edge, and the number of the connecting rods 1-400 is at least two. The first ends of two of the connecting rods 1-400 are hinged with the left side edge and the right side edge, respectively, and the second ends of the two connecting rods 1-400 are hinged with the first enclosure portion 1-210 and the third enclosure portion 1-230, respectively. Using this embodiment, different positions of the cover plate 1-300 are driven by the at least two connecting rods 1-400 to rotate when the shroud plate 1-200 is made to slide, by using the at least two connecting rods 1-400, which is conducive to improving the stability of the cover plate 1-300 in the rotation process.

Figure 6:
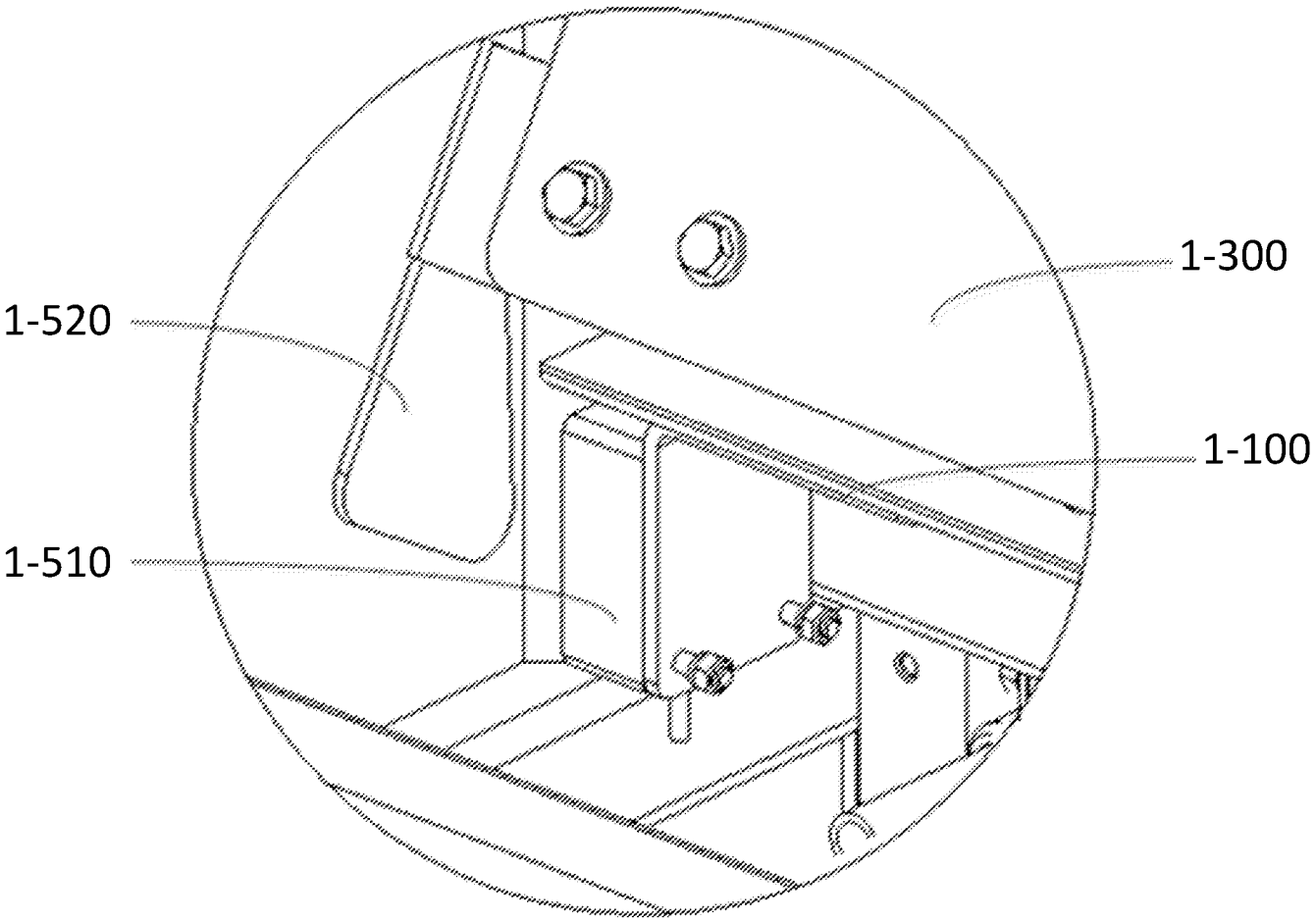
FIG. 6 is an enlarged view of A in FIG. 5.

In an optional embodiment, as shown in FIG. 6, the exhaust apparatus further includes a limit sensor 1-510 and an induction piece 1-520. One of the limit sensor 1-510 and the induction piece 1-520 is provided on the exhaust muffler 1-100, and the other one is provided on the cover plate 1-300. The limit sensor 1-510 is configured to detect the position of the induction piece 1-520. In a case that the limit sensor 1-510 detects that the induction piece 1-520 moves to a preset position relative to the limit sensor 1-510, the engine stops working, and/or, the exhaust muffler 1-100 gives an alarm. Optionally, the limit sensor 1-510 may be a proximity switch, specifically a formation switch, a position switch, etc. The limit sensor 1-510 may also be a displacement sensor. The exhaust apparatus can further include a controlling apparatus. The controlling apparatus is connected to the exhaust muffler 1-100, the engine and the limit sensor 1-510 via communications. In a case that the limit sensor 1-510 detects that the induction piece 1-520 moves to a preset position, the controlling apparatus controls the engine to stop working, and/or the controlling apparatus controls the exhaust muffler 1-100 to give an alarm. It is to be noted that the preset position can be set as needed.

In the rotation process of the cover plate 1-300, the relative position between the limit sensor 1-510 and the induction piece 1-520 will change. Therefore, by detecting the position of the induction piece 1-520 through the limit sensor 1-510, the relative position change between the cover plate 1-300 and the exhaust muffler 1-100 can be detected, thereby detecting the state of the second exhaust outlet 1-110. In a case that the limit sensor 1-510 detects that the induction piece 1-520 moves to the preset position, it indicates that the position of the cover plate 1-300 is abnormal. For example, the cover plate 1-300 abnormally closes the second exhaust outlet 1-110 or causes the opening degree of the second exhaust outlet 1-110 to be too small, which leads to that the engine in operation is unable to perform exhaust normally. Therefore, the engine stops working at this time, and/or the exhaust muffler 1-100 gives an alarm, and an operator further shuts down the engine according to alarm information, thereby avoiding that the engine is influenced due to the fact that the cover plate 1-300 abnormally closes the second exhaust outlet 1-110.

Figure 7:
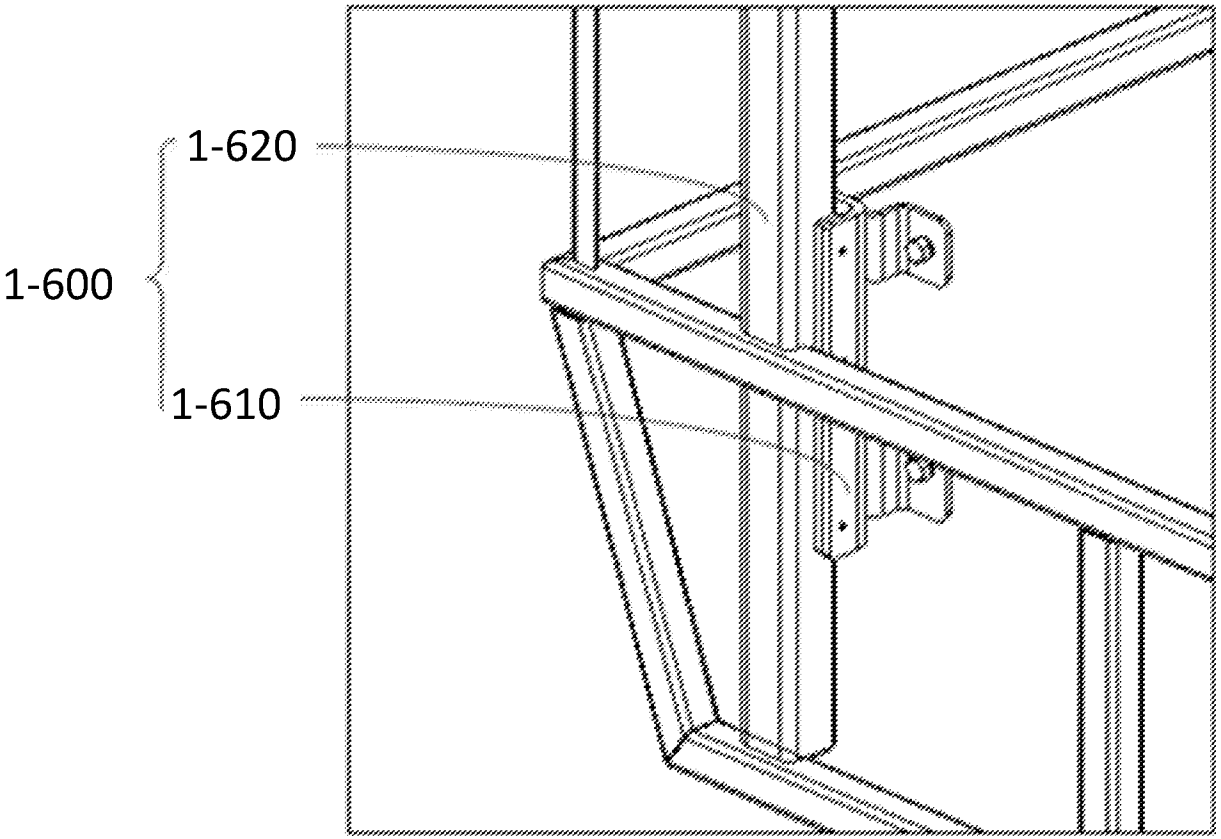
FIG. 7 is a schematic structural diagram of a guide mechanism according to an embodiment of this application.

In an optional embodiment, the exhaust apparatus further includes a guide mechanism 1-600. The guide mechanism 1-600 includes a guide rail 1-610 and a sliding piece 1-620. One of the guide rail 1-610 and the sliding piece 1-620 is provided on the exhaust muffler 1-100, and the other one is provided on the shroud plate 1-200. The guide rail 1-610 is in sliding fit with the sliding piece 1-620. Optionally, as shown in FIG. 7, the outer wall of the exhaust end of the exhaust muffler 1-100 is provided with the guide rail 1-610. The lower end of the shroud plate 1-200 is connected to a frame. The frame includes a sliding bar or sliding block. The sliding piece 1-620 may be the sliding bar or sliding block, the sliding piece 1-620 extends into the guide rail 1-610, and the sliding piece 1-620 is in pilot fit with the guide rail 1-610. Using this embodiment, the sliding direction of the shroud plate 1-200 is guided by using the guide mechanism 1-600, so that the shroud plate 1-200 can accurately move in the guide direction of the guide rail 1-610, thereby avoiding deviation in the movement direction of the shroud plate 1-200. Of course, in other embodiments, in the process of driving the shroud plate 1-200 to slide by means of a drive mechanism 1-700 or under the action of an external force, if the sliding direction of the shroud plate 1-200 is the vertical direction, the shroud plate 1-200 accurately rises and falls in the height direction of the exhaust apparatus, then the guide mechanism 1-600 may not be provided.

In an optional embodiment, the number of the guide mechanisms 1-600 is at least two, and at least two of the guide mechanisms 1-600 are provided on opposite sides of the exhaust muffler 1-100, respectively. Optionally, the at least two of the guide mechanisms 1-600 are connected to the first enclosure portion 1-210 and the third enclosure portion 1-230, respectively. As such, different positions of the shroud plate 200 are respectively guided by the at least two guide mechanisms 1-600, which further makes the whole of the shroud plate 1-200 accurately move along the guide direction of the guide rail 1-610. Moreover, the exhaust muffler 1-100 and the shroud plate 1-200 are connected in a sliding manner by the guide mechanism 1-600. Therefore, the guide mechanism 1-600 and the exhaust muffler 1-100 provide support to the shroud plate 1-200, thereby avoiding the detachment of the shroud plate 1-200 from the exhaust muffler 1-100 in the case of the abnormal drive effect.

Figure 8:
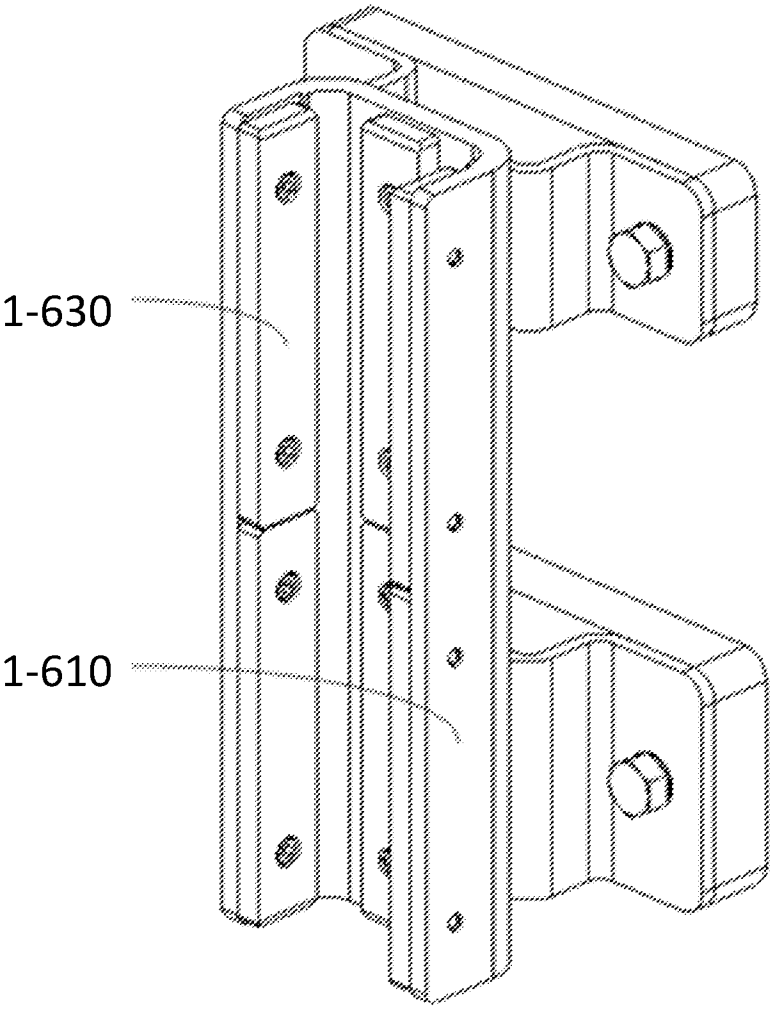
FIG. 8 is a schematic structural diagram of a guide rail according to an embodiment of this application.

In an optional embodiment, as shown in FIG. 8, the guide rail is of a "U" shaped structure, the guide rail 1-610 is provided with a sliding groove, a lubrication plate 1-630 is provided in the sliding groove, and the sliding piece 1-620 is in clearance fit with the lubrication plate 1-630. As such, a lubricant is applied to the lubrication plate 1-630, which is conducive to smooth sliding of the sliding piece 1-620 and avoid that the sliding piece 1-620 is stuck in the sliding process. Moreover, a chamfer is provided at the end or edge of the lubrication plate 1-630 to avoid that wear of the sliding piece 1-620 in the sliding process is caused by the fact that the lubrication plate 1-630 is too sharp.

In an optional embodiment, the shroud plate 1-200 can be driven under the manual action to move relative to the exhaust muffler 1-100. In another embodiment, the exhaust apparatus further includes the drive mechanism 1-700. The drive mechanism 1-700 is connected to the shroud plate 1-200 to drive the shroud plate 200 to move relative to the exhaust muffler 1-100. Optionally, in a case that the shroud plate 1-200 is connected to the exhaust muffler 1-100 in a sliding manner, the drive mechanism 1-700 may be a telescopic piece such as an air cylinder or hydraulic cylinder, or a drive source such as a linear module. One end of the drive mechanism 1-700 is a fixed end, and the moving end of the drive mechanism 1-700 directly drives the shroud plate 1-200 to move. In a case that the shroud plate 1-200 is rotationally connected to the exhaust muffler 1-100, the drive mechanism 1-700 may be the telescopic piece such as the air cylinder or hydraulic cylinder, one end of the telescopic piece is hinged with the outer wall of the exhaust muffler 1-100, and the other end of the telescopic piece is hinged with the shroud plate 1-200. When the telescopic piece stretches out and draws back, the shroud plate 200 is driven to rotate relative to the exhaust muffler 1-100.

Using this embodiment, the shroud plate 1-200 is driven by using the drive mechanism 1-700 to move to avoid the manual action, so that the switching efficiency of the shroud plate 1-200 between the first position and the second position is improved, thereby guaranteeing timely exhaust of the exhaust apparatus or timely closure of the second exhaust outlet 1-110.

Based on the exhaust apparatus disclosed above, the embodiments of this application further disclose an engine. The engine disclosed includes the exhaust apparatus in the foregoing embodiments.

Further, based on the engine disclosed above, the embodiments of this application further disclose a fracturing device. The fracturing device disclosed includes the engine in the foregoing embodiments.

FIG. 9-FIG. 13 show example embodiments of a rain cover assembly and a pipe mounted with the rain cover assembly according to the present disclosure.

Figure 9:
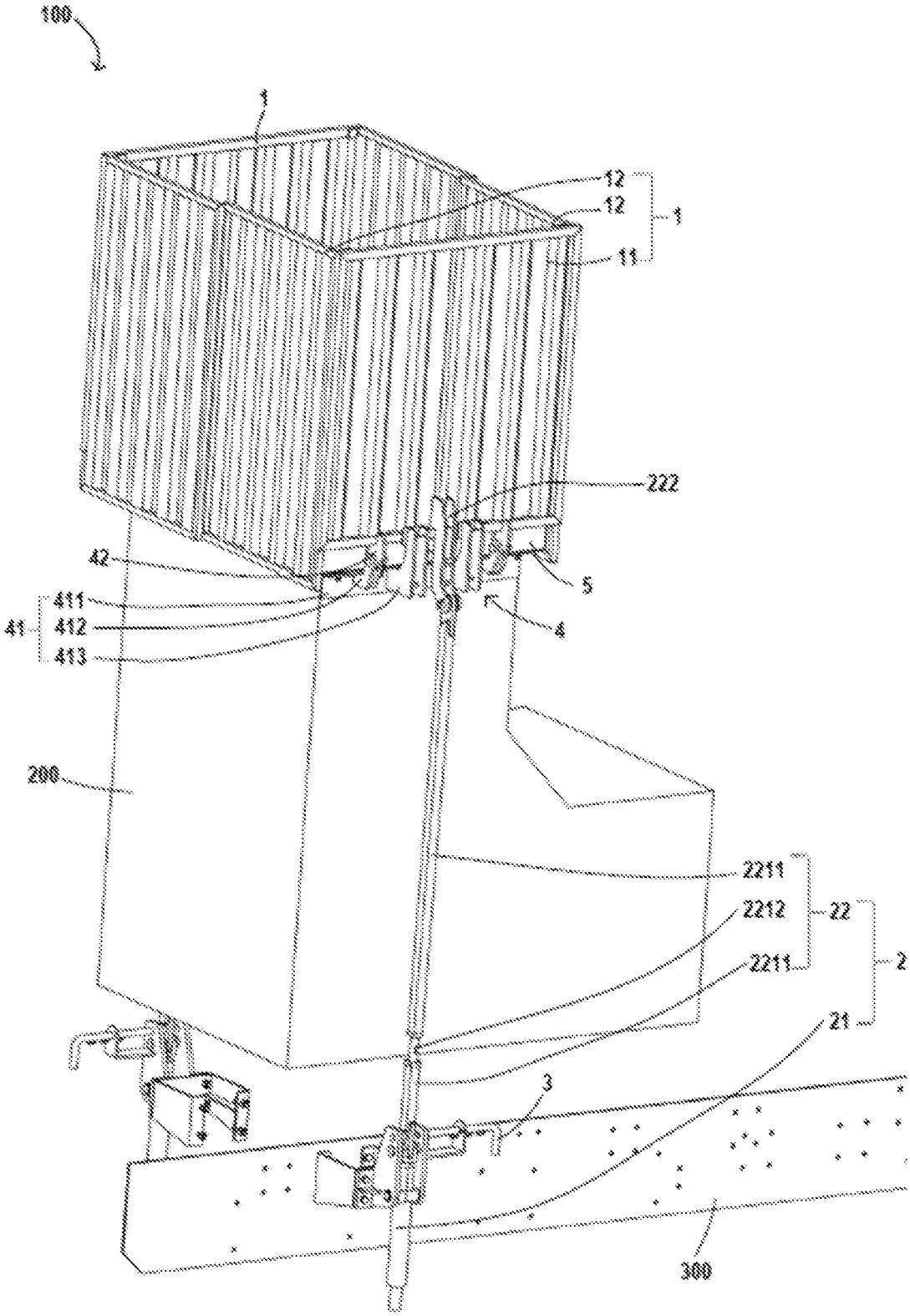
FIG. 9 shows a schematic view in which a rain cover assembly is mounted on a pipe according to a preferred embodiment of the present disclosure, wherein a cover plate of the rain cover assembly is at an open position.

First, referring to FIG. 9, the rain cover assembly 100 is mounted on an open end of a pipe 200. The pipe 200 may be, for example, an exhaust port of a turbine engine mounted in a turbine fracturing unit, or an exhaust muffler mounted at an exhaust port. The rain cover assembly 100 includes two sets of cover plate assemblies. Taking the set of cover plate assembly shown roughly in FIG. 9 as an example, each set of cover plate assembly substantially includes a cover plate 1, a power mechanism 21, a transmission mechanism 22 and a locking device 3.

As shown in FIG. 9, in the present embodiment, the pipe 200 opens upward. First of all, it needs to be appreciated that "a centerline of the pipe" mentioned in the text herein is a straight line which is perpendicular to a plane where the opening of the pipe is located and passes through the center of the opening.

The cover plate 1 is mounted at the open end of the pipe 200 and capable of pivoting in a vertical plane between a closed position where the cover plate covers the opening and an open position where the cover plate exposes the opening. It may be appreciated that its pivot axis is perpendicular to the centerline of the pipe 200. It needs to be clarified that when the cover plate 1 is at the closed position, the entire opening may be covered or only a portion of the opening may be covered; when all the cover plates 1 are at the closed position, they may jointly cover the opening of the cover 200 completely. One end of the transmission mechanism 22 is connected to the cover plate 1 and can drive the cover plate 1 to pivot between the open position and the closed position. The other end of the transmission mechanism 22 is indirectly connected to the locking device 3 through the power mechanism 21, and is configured to lock the transmission mechanism 22 and thereby lock the cover plate 1 when the cover plate 1 is at the open position. Certainly, it is also possible that there is not a power mechanism 21, and the transmission mechanism 22 is directly connected to the locking device 3. At this time, manual operation is required.

Figure 11:
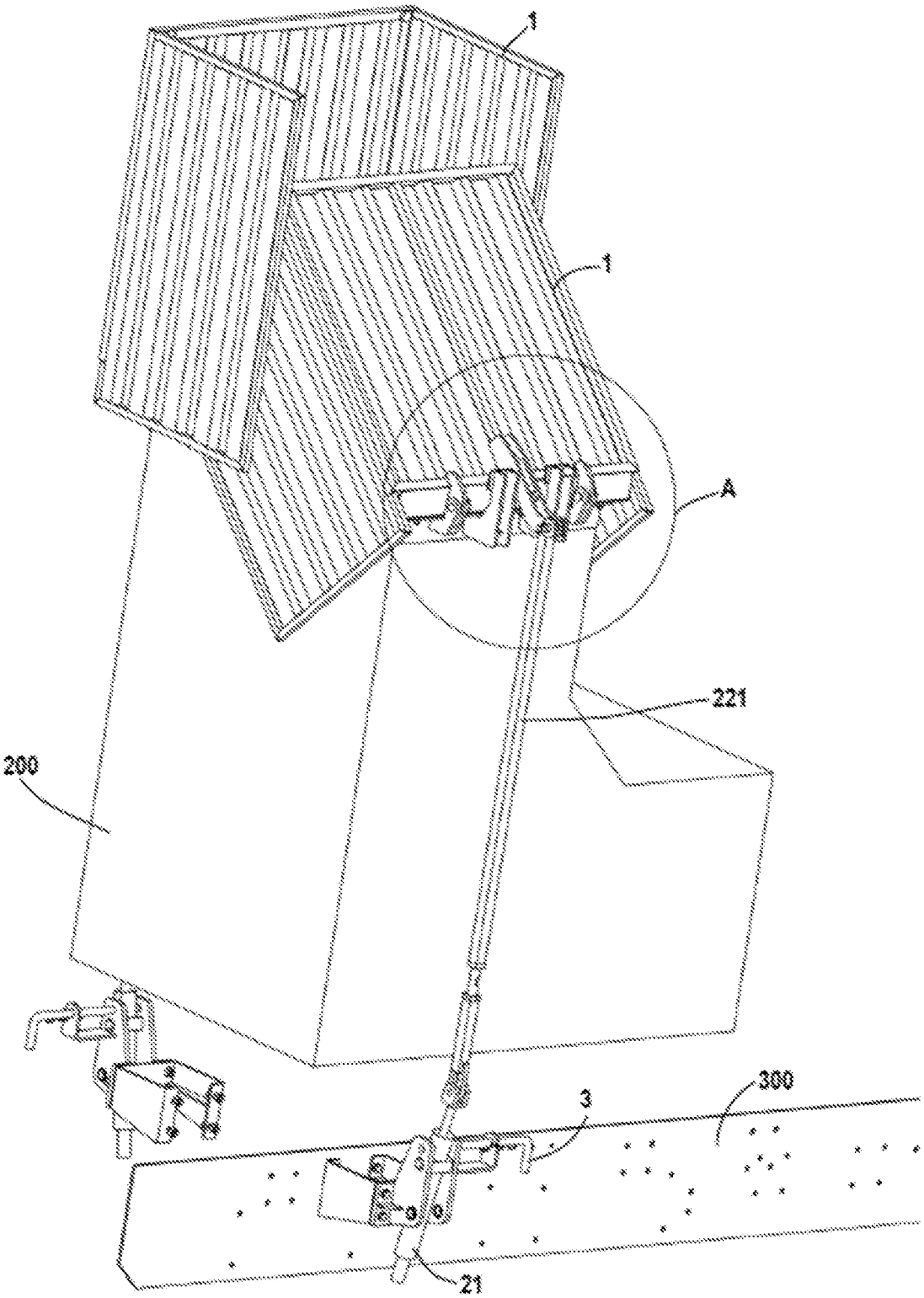
FIG. 11 is a view of another state of the structure shown in FIG. 9, wherein the cover plate of the rain cover assembly is located at an intermediate position between an open position and a closed position.
Figure 13:
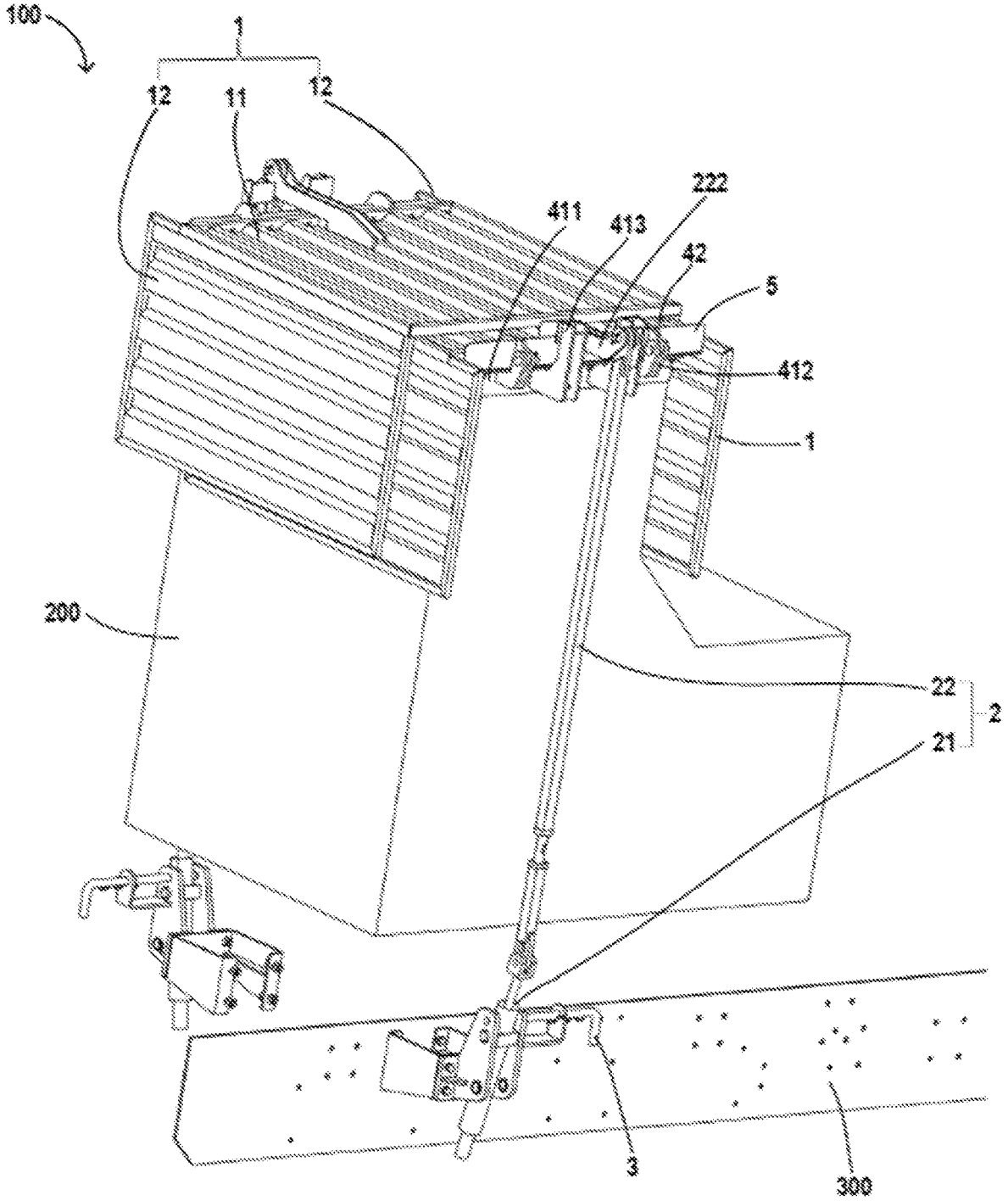
FIG. 13 is a view of a further state of the structure shown in FIG. 9, wherein the cover plate of the rain cover assembly is at the closed position.

Continuing to refer to FIG. 9, FIG. 11 and FIG. 13, the cover plates 1 of the two cover plate assemblies are symmetrically arranged about the opening, and each cover plate 1 includes an intermediate plate 11 and two side plates 12 respectively connected to the two opposite endings of the intermediate plate 11, wherein the intermediate plate 11 is perpendicular to the side plates 12. As shown in FIG. 9, when the two cover plates 1 are at the open position, the intermediate plate 11 and the side plates 12 of each cover plate 1 all extend in the vertical direction, and the two cover plates 1 jointly form a closed additional pipe structure which is open at both ends and extends in the vertical direction. The additional pipe structure is located above the pipe 200 and communicated with the opening of the pipe 200. The shape of the additional pipe structure is similar to a chimney mounted at the top end of the pipe 200. As shown in FIG. 13, when the two cover plates 1 are at the closed position, the intermediate plate 11 of each cover plate 1 covers the opening and the side plates 12 abut against the outside of the wall surfaces of the pipe 200. More specifically, the intermediate plates 11 of the two cover plates 1 covers the opening overlappingly.

In an embodiment not shown, the rain cover assembly may include more cover plate assemblies, the cover plates of respective cover plate assemblies are evenly arranged around edges of the opening, and the cover plates of respective cover plate assemblies are configured in a way that when the cover plates are at the open position, the cover plates are connected end-to-end around the horizontal direction (or may be partially overlapped) to form a closed additional pipe structure which extends in the vertical direction with both ends open. The additional pipe structure is located above the pipe and continues along the opening of the pipe. When the cover plate of each cover plate assembly is at the closed position, the cover plates at least partially overlap.

Each cover plate assembly further includes a connecting member 4 connecting the cover plates 1 with the pipe 200.

Figure 10:
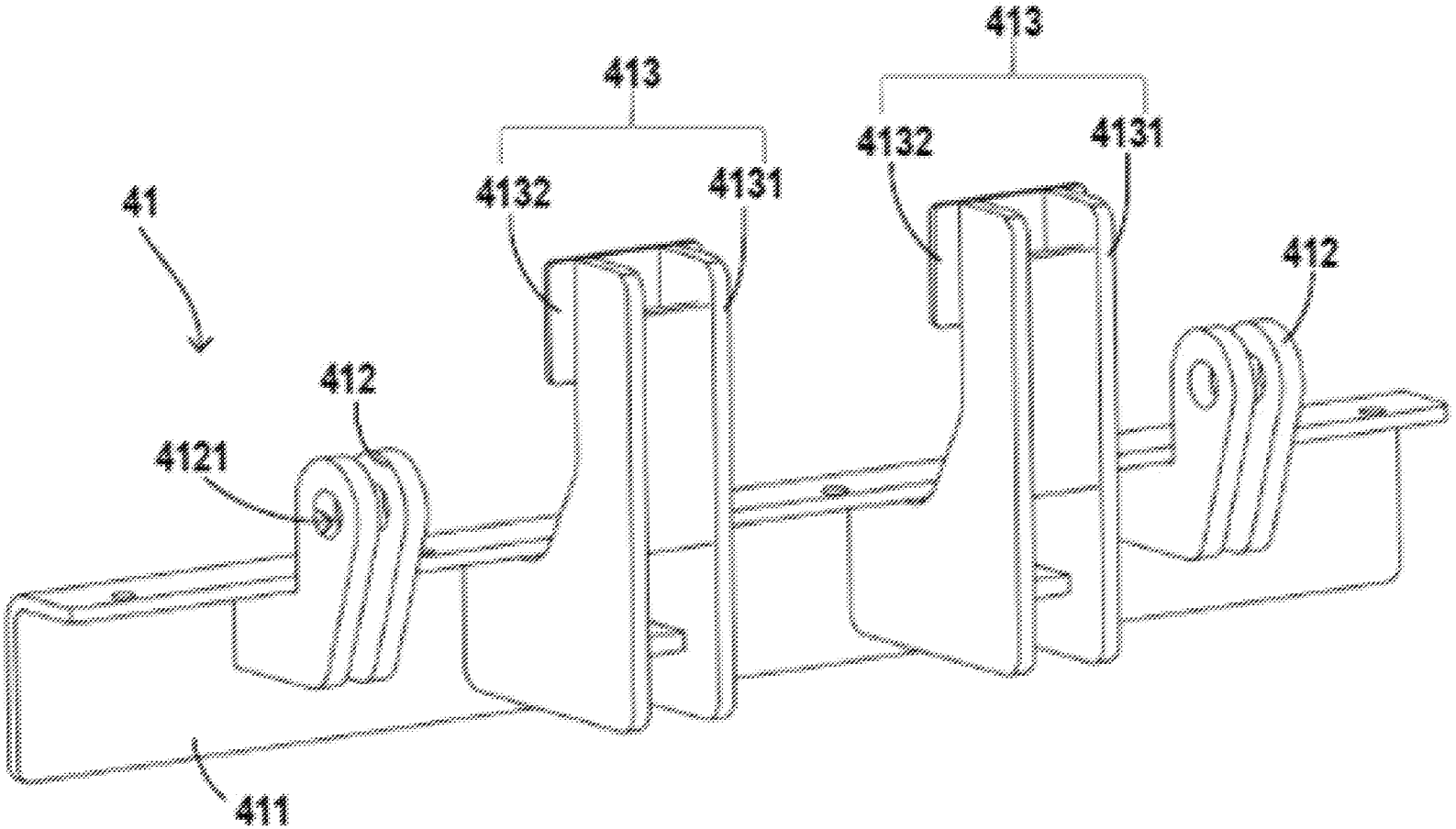
FIG. 10 is an enlarged view of partial structures of a connecting member in the rain cover assembly shown in FIG. 9.
Figure 12:
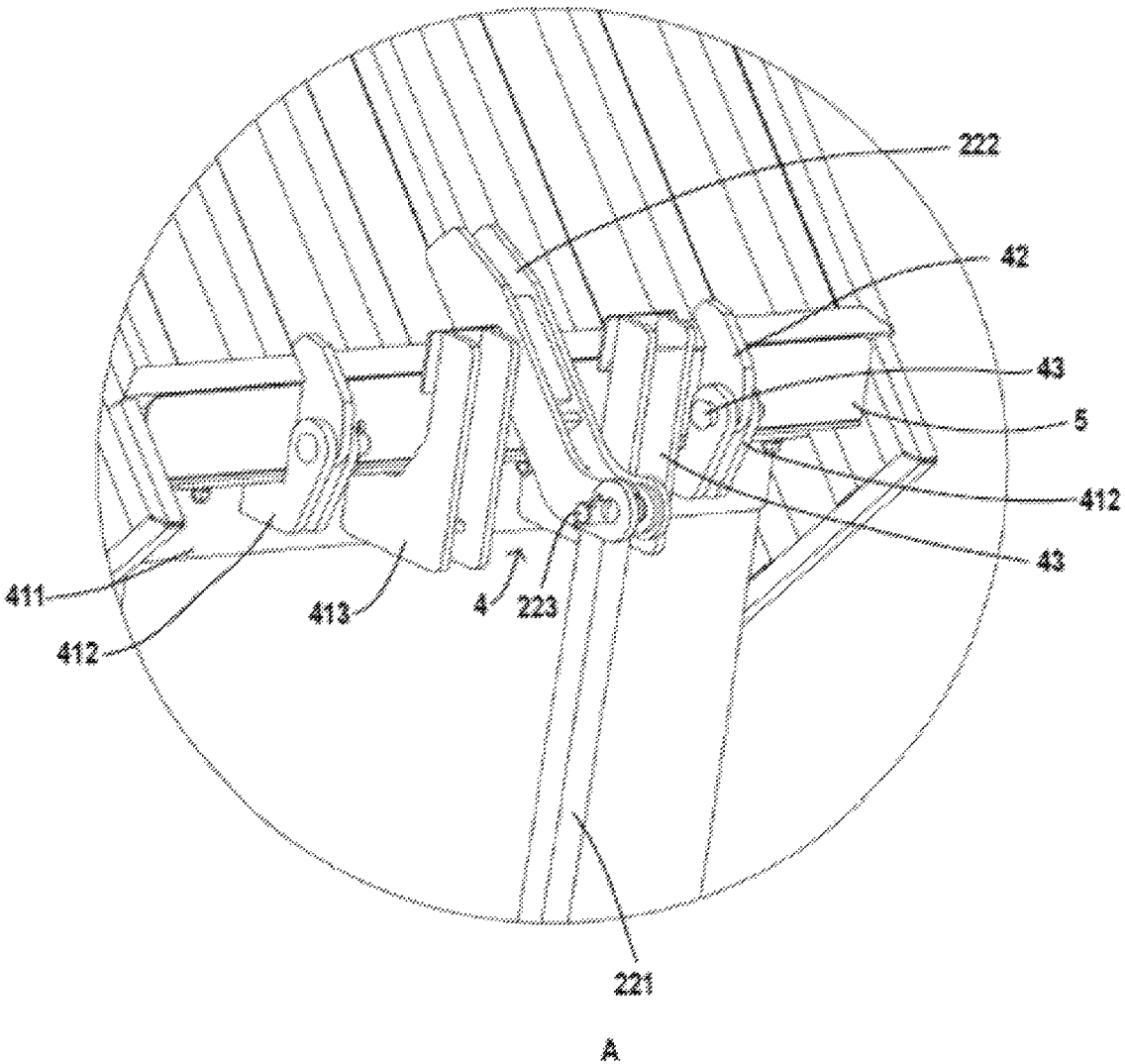
FIG. 12 is a partially enlarged view of portion A of FIG. 11.

Referring to FIG. 10 and FIG. 12, a base 41 of the connecting member 4 is an integral member formed by welding. The base 41 is fixedly mounted on the pipe 200, and a pivoting portion 42 is pivotally connected with the base 41 via a first pin 43 (see FIG. 12). The pivoting portion 42 is fixed on the cover plate 1 and can pivot together with the cover plate 1 relative to the base 41 (i.e., relative to the pipe 200). Further, the base 41 further includes a base plate 411, an ear 412 and a limiting portion 413. A portion of the base plate 411 is parallel to the pivot axis of the cover plate 1 and abuts the outer wall of the pipe 200. The ear 412 extends away from the pipe. The ear 412 is formed with a pivot shaft mounting hole 4121, and the pivoting portion 42 is a plate-shaped structure and mounted together with the ear 412 by the first pin 43 penetrating through the pivot mounting hole 4121. Preferably, one ear 412 includes two plate-shaped structures, and the pivoting portion 42 is correspondingly sandwiched between the two plate-shaped structures.

The arrangement of such as connecting member 4 can facilitate the proper connection between the cover plate 1 and the pipe 200, and not only ensures the connection strength of the two, but also provides the flexibility of the cover plate 1 relative to the pipe 200.

In some example implementations, the limiting portion 413 is configured in a way that the limiting portion 413 abuts against the cover plate when the cover plate 1 pivots to the open position, to limit further pivoting of the cover plate 1. A state when the limiting portion 413 limits the cover plate 1 to the open position is shown in FIG. 9. Referring to FIG. 10, the limiting portion 413 for example may include an extension structure 4131 extending upward from the base plate 411 and a limiting plate 4132 mounted on the extension structure 4131 and facing the cover plate 1. The arrangement of the limiting portion 413 can limit the excessive movement of the cover plate 1 relative to the pipe 200, thereby ensuring the connection strength between the cover plate 1 and the pipe 200, and preventing the cover plate 1 from being disconnected from the pipe 200 due to excessive movement, and in the meanwhile can facilitate the formation of the closed additional pipe.

In some example implementations, the rain cover assembly 100 further includes a baffle 5 fixed relative to the pipe 200 and extending along a connection gap between the pipe 200 and the cover plate 1 to cover the gap. The baffle 5 may be fixed together with the connecting member 4.

Referring to FIG. 9, FIG. 11 and FIG. 13, the power mechanism 21 and the transmission mechanism 22 jointly function as a driving device 2. The transmission mechanism 22 further includes a transmission rod engaged with the power mechanism 21. A forced ear 222 is disposed on the cover plate, and the forced ear 222 is pivotally connected with the transmission rod via a second pin 223 (see FIG. 12). The power mechanism 21 can drive the transmission rod to move substantially up and down, and drive the forced ear 222 to drive the cover plate 1 to pivot.

As described above, the forced ear 222 of the driving device 2 and the pivoting portion 42 of the connecting member 4 are both fixed on the cover plate 1, and the three move jointly. In the joint movement of the forced ear 222 and the cover plate 1, the forced ear 222 is a driving member, and the cover plate 1 is a driven member. In the joint movement of the cover plate 1 and the pivoting portion 42, the cover plate 1 is a driving member, and the pivoting portion 42 is a driven member.

In some example implementations, the length of the transmission rod of the driving device 2 is adjustable. For example, the transmission rod includes a first rod portion 2211 and a second rod portion 2212, and the second rod portion 2212 is sleeved in two adjacent first rod portions 2211 to form a telescopic structure. Such a telescopic structure may be realized by any suitable mechanism in the prior art.

The power mechanism 21 may include an electric power mechanism or a pneumatic power mechanism, which includes, for example, an electric cylinder or a hydraulic cylinder. For example, the transmission mechanism 22 may be provided with a gear-rack mechanism, a cam mechanism, an electric winch mechanism, etc., in addition to or an alternative to the transmission rod for transmission.

When the rain cover assembly is applied to a small pipe, the cover plate may be opened and closed manually. In such an embodiment, the rain cover assembly may only include the transmission mechanism and not include the power mechanism, and the end of the transmission mechanism opposite to the cover plate may be set to be directly connected to a locking device to lock the cover plate at a predetermined position.

The locking device 3 may include the pull bolt shown in the figure(s). During the opening and closing of the cover plate 1, the pull bolt may be pulled outward to make the driving device 2 operable. When the cover plate 1 reaches the open position, the pull bolt may be inserted into a bolt hole to lock the driving device 2 to further lock the cover plate 1 at the open position. When the cover plate 1 is at the closed position, the locking device 3 may lock the driving device 2, or may keep an unlocked state so that the cover plate 1 may rest at the closed position freely.

Figure 14:
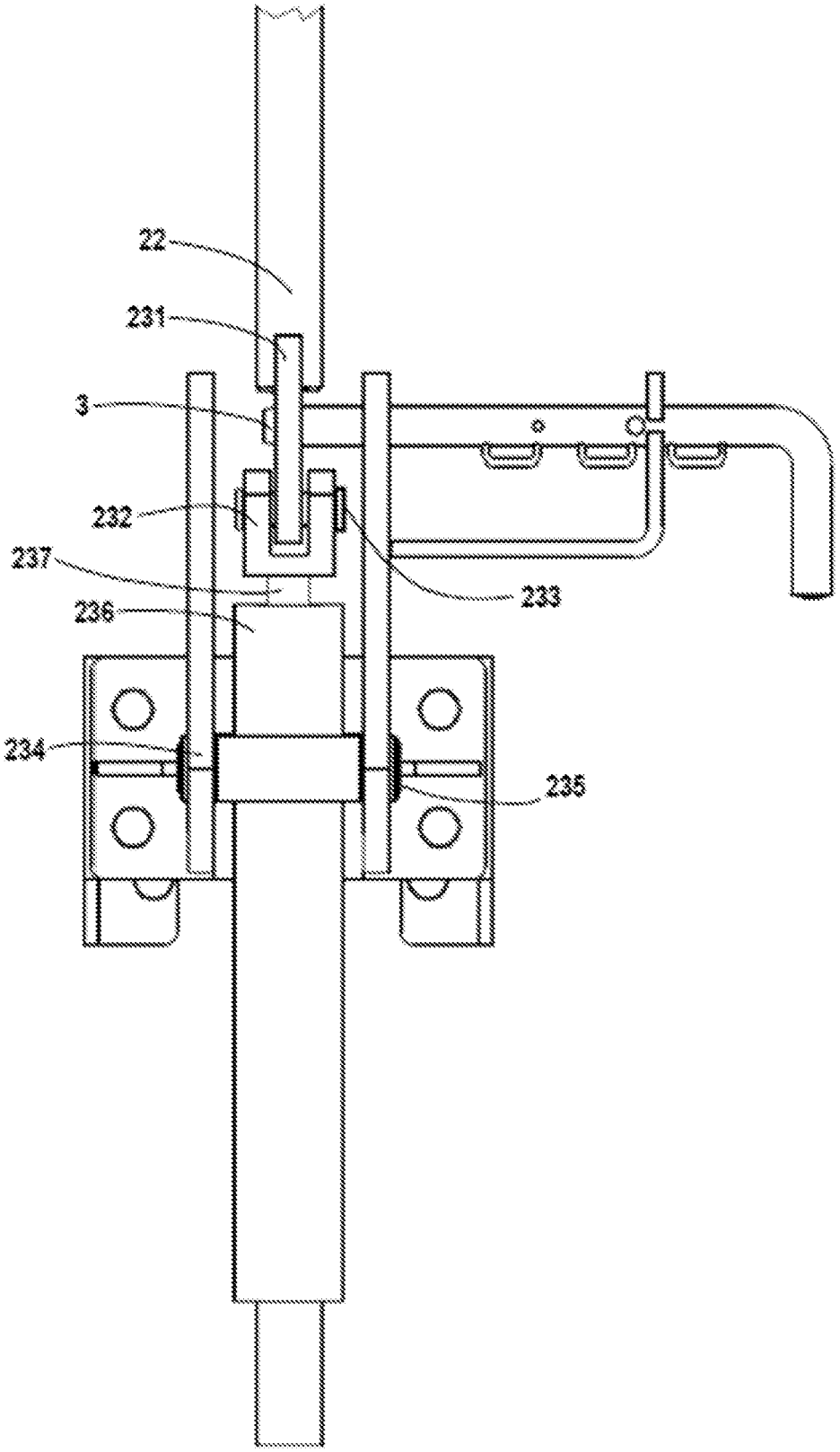
FIG. 14 is a front view at a power mechanism and a locking device in FIG. 9.

FIG. 14 shows an example of a specific cooperation relationship between the power mechanism 21 and the locking device 3. Referring to FIG. 14, the power mechanism 21 includes a hydraulic cylinder 236, a hydraulic rod 237, and a hydraulic rod ear 232 fixedly disposed at a top end of the hydraulic rod 237. A bottom end of the transmission mechanism 22 is fixedly connected with a support rod 231, and the support rod 231 and the hydraulic rod ear 232 are pivotally connected to each other by a second pivot 233. Furthermore, clamp plates 234 parallel to each other are disposed fixedly relative to the pipe, the hydraulic cylinder 236 is mounted between the two clamp plates 234 via the first pivot 235, and the first pivot 235 is parallel to the second pivot 233. When the hydraulic cylinder operates, the hydraulic cylinder 236 can rotate about the first pivot 235 relative to the pipe, and meanwhile, the support rod 231 rotates about the second pivot 233 relative to the hydraulic rod ear 232.

Furthermore, the support rod 231 is provided with a through hole, the locking device 3 includes a pull bolt, and the pull bolt can be inserted into the through hole on the support rod 231 to lock the position of the transmission mechanism 22. After the locking device 3 locks the position of the transmission mechanism 22, the hydraulic cylinder is in an unstressed state.

Figure 15:
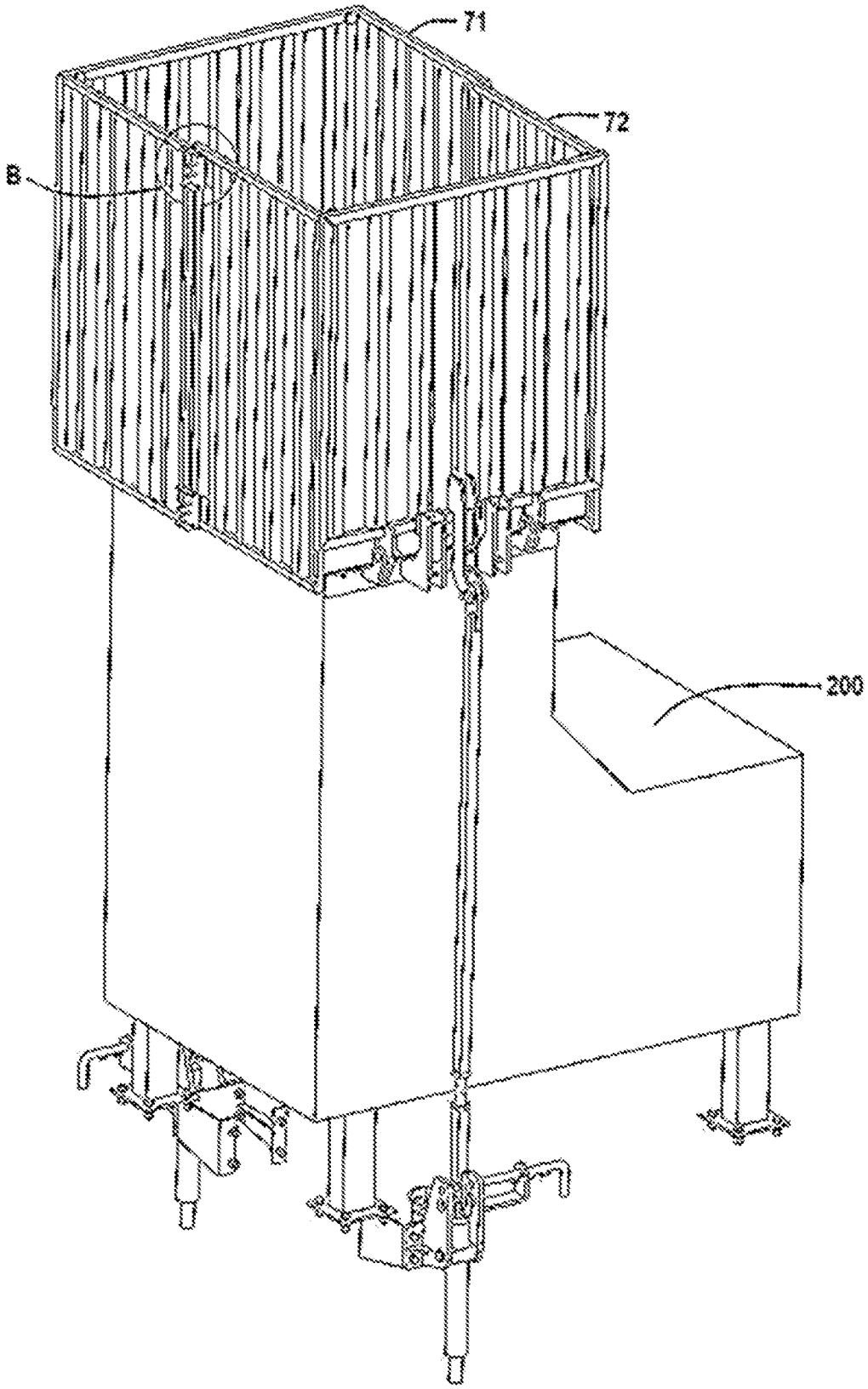
FIG. 15 shows a schematic view in which a rain cover assembly is mounted on a pipe according to another preferred embodiment of the present disclosure, wherein the cover plate of the rain cover assembly is at an open position.
Figure 16:
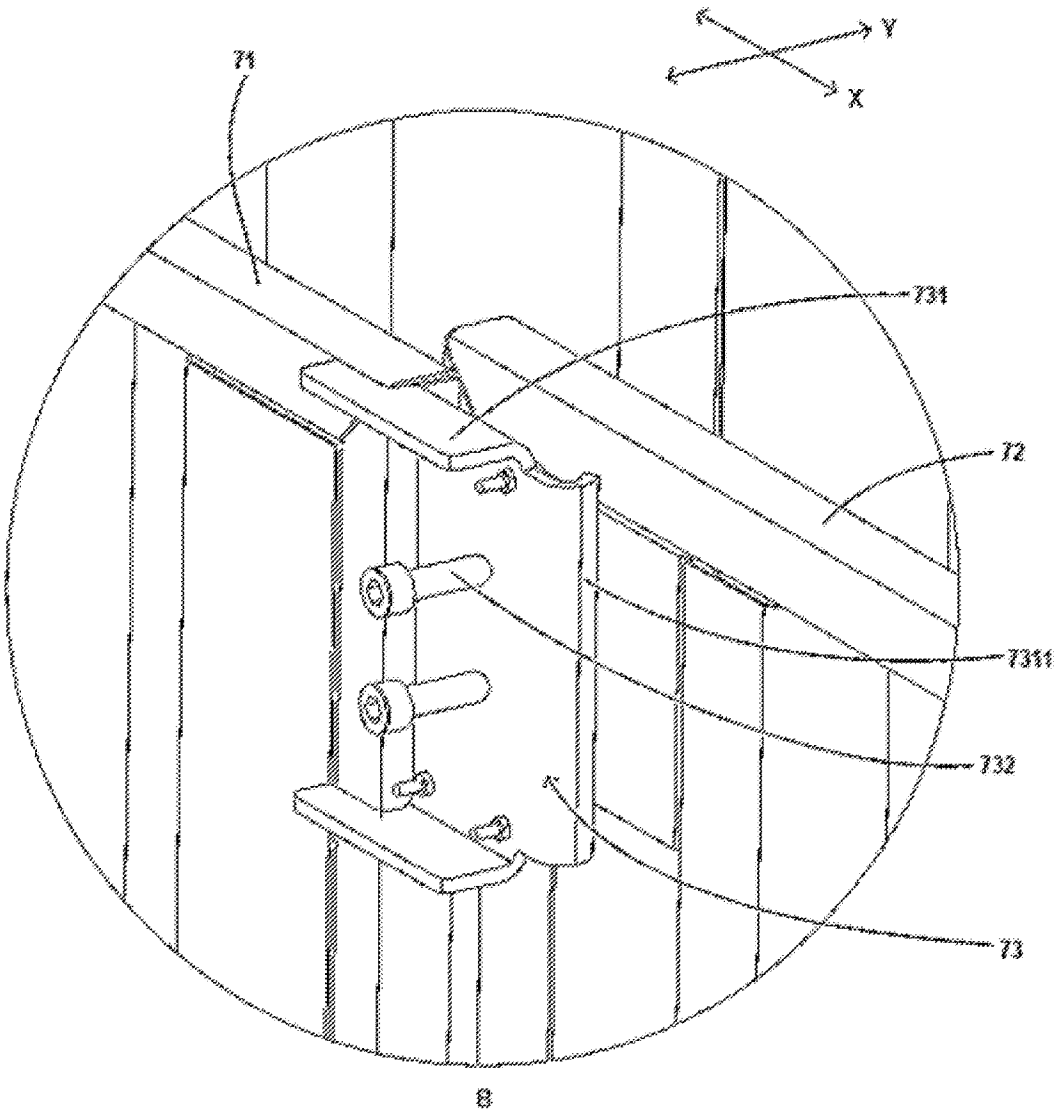
FIG. 16 is a partially enlarged view of portion B of FIG. 15.
Figure 17:
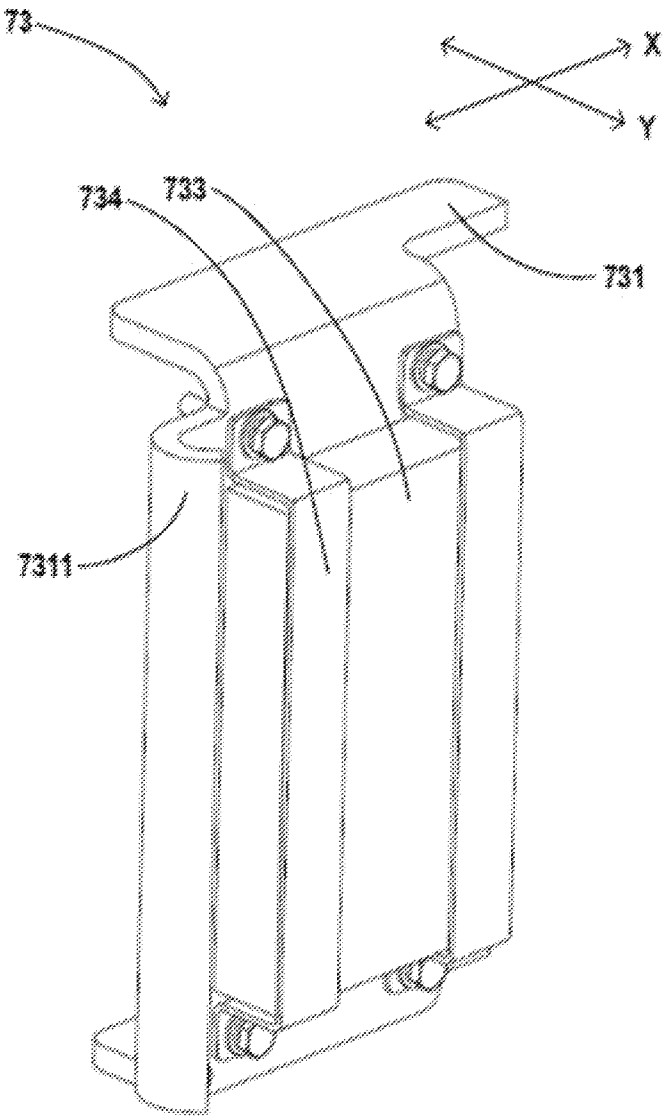
FIG. 17 is a perspective space view of another view of an additional locking device in FIG. 16 from another perspective.

In addition to the above arrangement, the rain cover assembly may further include some other structures. For example, in the embodiment shown in FIG. 15 and FIG. 16, the rain cover assembly 700 further includes an additional locking device 73 arranged between two adjacent cover plates. The additional locking device 73 can be used to fix the two adjacent cover plates relative to each other when the cover plate is at the open position, to prevent the cover plate from vibration and popping during transportation and operation. An example of a specific structure of the additional locking device 73 is shown in FIG. 16 and FIG. 17. The additional locking device 73 is fixedly connected to one of the two adjacent cover plates, and releasably fixed with the other of the two adjacent cover plates. For the ease of description, the two adjacent cover plates shown in FIG. 15 and FIG. 16 are referred to as a first cover plate 71 and a second cover plate 72.

Referring to FIG. 16 and FIG. 17, the additional locking device 73 includes a mounting plate 731, a magnet 733, a U-shaped pressing plate 734 and ejector rods 732. The mounting plate 731 is fixedly connected to the first cover plate 71 and protrudes toward the second cover plate 72 along an X direction. The X direction is parallel to the side plates of the first cover plate 71 and the second cover plate 72. The second cover 72 has a metal rim. The magnet 733 is provided on a portion of the mounting plate 731 that protrudes from the first cover plate 71, and the magnet 733 and the metal rim of the second cover plate 72 face each other in a Y direction. The Y direction is perpendicular to the side plates of the first cover plate 71 and the second cover plate 72. The magnet 733 is a high temperature-resistant and high-strength magnet, and can withstand high-temperature exhaust gas discharged from the turbine engine.

Furthermore, there are two U-shaped pressing plates 734, and both ends of each U-shaped pressing plate 734 are detachably connected to the surface of the mounting plate 731 facing the second cover plate 72, so that the magnet 733 is cooperatively received in a space jointly defined by the U-shaped pressing plates 734 and the mounting plate 731. The two U-shaped pressing plates 734 are arranged along the X direction. The U-shaped pressing plates 734 can function to protect the magnet 733 and avoid damages to the magnet caused by direct collision and contact between the magnet 733 and the second cover 72.

Furthermore, the mounting plate 731 is provided with through holes. The ejector rods 732 run through the through holes and can be locked relative to the mounting plate 731. The ejector rods 732 can press the magnet 733 in the Y direction, so that the magnet 733 can be pressed tightly between the ejector rods 732 and U-shaped pressing plates 734. There are two ejector rods 732, and the two ejector rods 732 are arranged in a direction perpendicular to both the X direction and the Y direction.

Since the U-shaped pressing plates 734 are detachable, U-shaped pressing plates 734 of different sizes may be selected according to actual needs. For example, U-shaped pressing plates having a larger size in the Y direction than the U-shaped pressing plates 734 shown in FIG. 17 may be selected. After that selected U-shaped pressing plates are mounted on the mounting plate 731 and the magnet 733 is placed in the space jointly defined by the U-shaped pressing plates 734 and mounting plate 731, the ejector rods may be screwed tightly to press the magnetic 733 between the U-shaped pressing plates and the ejector rods 732. At this time, there may be a certain gap between the magnet 733 and the mounting plate 731, and therefore, the magnet 733 might be closer to the metal rim of the second cover plate 72, thereby generating a greater attractive force to the second cover plate 72. In other words, the distance between the two cover plates can be made in an optimal state by replacing U-shaped pressing plates of different sizes.

In some example implementations, the edge of the mounting plate 731 is provided with an arcuate segment 7311 bent toward the second cover plate 72. The arcuate segment 7311 is provided to prevent the magnet 733 from being hit by other components. The size of the arcuate segment 7311 in a thickness direction of the mounting plate 731 (i.e., the Y direction) is smaller than the size of the magnet 733 in the thickness direction of the mounting plate 731, so the arcuate segment 7311 will not interfere with the second cover plate 72.

The cover plate of the rain cover assembly according to the present disclosure may also have various structural forms. For example, instead of the cover structure shown in FIG. 9 and FIG. 15, FIG. 18A-FIG. 18D show top views of cover plates of several rain cover assemblies in an open state. The embodiments shown in FIG. 18A through FIG. 18C all include two cover plates.

Figures 18A, 18B, 18C:
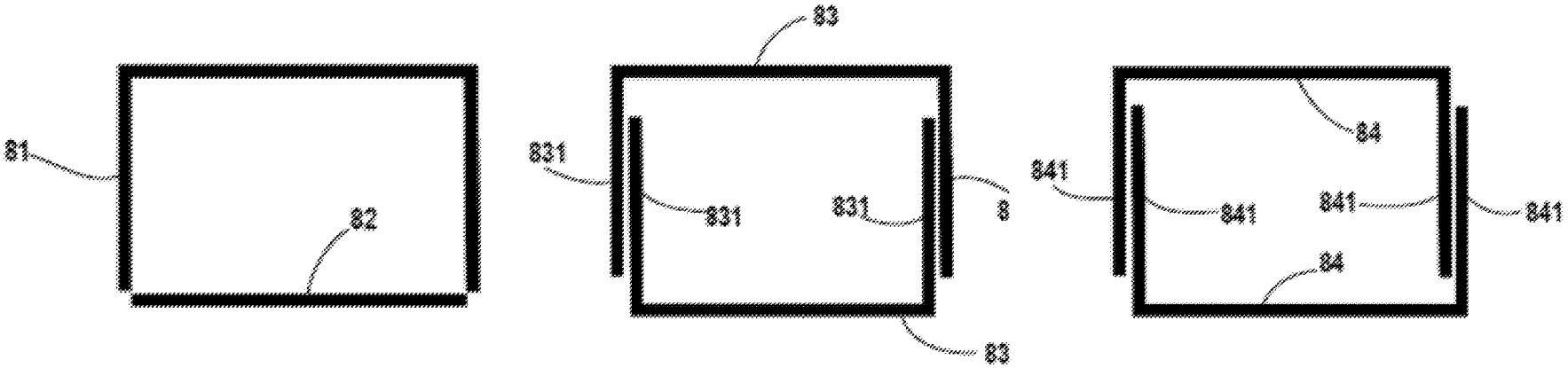
FIG. 18A-FIG. 18C are schematic diagrams of top views of several alternative solutions of the cover plate in FIG. 9 and FIG. 15, the cover plate being at the open position in FIG. 18A-FIG. 18C.

In FIG. 18A, the first cover plate 81 includes an intermediate plate and two side plates, the second cover plate 82 is a single plate structure, and the intermediate plate, two side plates of the first cover plate 81 and the second cover plate 82 can jointly form an additional pipe structure.

In FIG. 18B, each cover plate 83 includes an intermediate plate and two side plates 831, and the corresponding side plates 831 of the two cover plates 83 partially overlap when at the open position. The two side plates 831 of one cover plate 83 are both located inside the two side plates 831 of the other cover plate 83.

In FIG. 18C, each cover plate 84 includes an intermediate plate and two side plates 841, and the corresponding side plates 841 of the two cover plates 84 partially overlap when at the open position. One side plate 841 of one cover plate 84 is located inside one side plate 841 of the other cover plate 84; the other side plate 841 of the one cover plate 84 is located outside the other side plate 841 of the other cover plate 84.

The rain cover assembly may further include only one set of cover plate assembly. For example, in FIG. 18D, the cover plate in the set of cover plate assembly includes a pipe-shaped structure 851 and a covering plate 852. The pipe-shaped structure 851 can translate relative to the pipe along an extension direction of the pipe; the covering plate 852 is disposed at one end of the pipe-shaped structure 851 and can pivot relative to the pipe-shaped structure 851 to open or close the pipe-shaped structure 851. The cover plate is configured such that when the cover plate is at the open position, the pipe-shaped structure 851 is formed as an additional pipe structure, and the covering plate 852 abuts against the outside or inside of the pipe-shaped structure 851; when the cover plate is at the closed position, the pipe-shaped structure 851 is sleeved inside or outside the pipe, and the covering plate 852 covers the opening of the pipe-shaped structure.

Figure 18E:
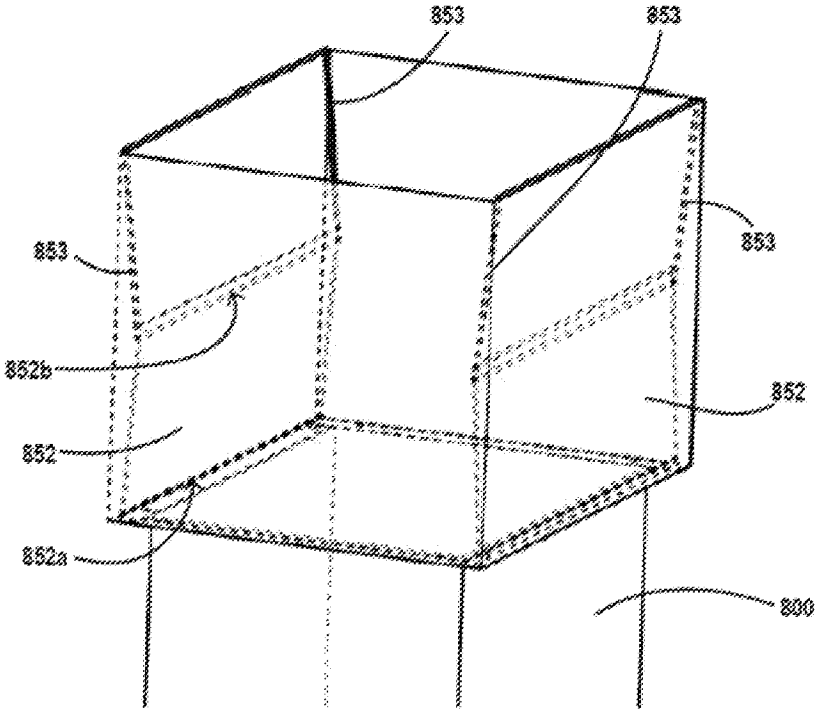
FIG. 18D and FIG. 18E are perspective space views of another alternative embodiment of the cover plate assembly of FIG. 9.
Figure 18D:
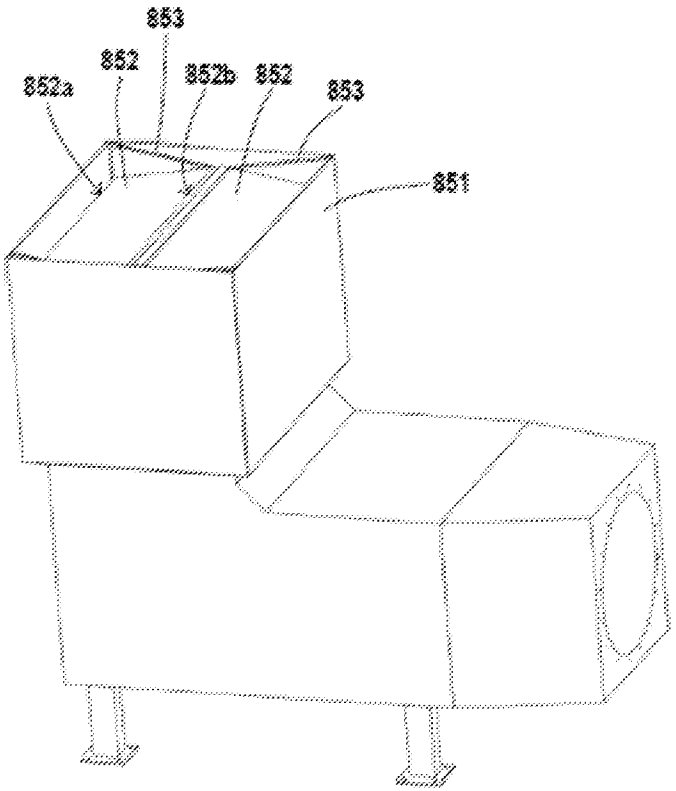

A more specific example structure of the above solution is shown with reference to FIG. 18D and FIG. 18E. In such example implementations, there are two covering plates 852, one end 852*a* of each covering plate is connected to the pipe, and the other end 852*b* of the covering plate is connected to the pipe-shaped structure 851 through an articulation lever 853. Such an arrangement makes it possible to make the covering plate 852 opened when the pipe-shaped structure 851 moves upwards and thereby drives the other end 852*b* of the covering plate to move upwards simultaneously.

When the opening of the pipe 800 needs to be exposed, when the pipe-shaped structure 851 moves upward relative to the pipe 800, the other end 852*b* of the covering plate 852 is indirectly driven by the pipe-shaped structure 851 via the articulation lever 853 to pivot upwards, and one end 852*a* of the cover plate is always fixed relative to the pipe 800 in this process so that the covering plate 852 is opened (approximately as shown in FIG. 18E).

When the opening of the pipe 800 needs to be covered, when the pipe-shaped structure 851 moves downward relative to the pipe 800, the pipe-shaped structure 851 drives the other end 852*b* of the covering plate 852 to pivot downward via the articulation lever. In this process, the one end 852*a* of the covering plate is always fixed relative to the pipe 800 so that finally the covering plate 852 covers the opening of the pipe 800 (approximately as shown in FIG. 18D).

In addition to the above-mentioned pivotal movement and translational movement, in other unshown embodiments, the cover plate may also include pivotal movements in other directions. For example, there may be a section of pivotal movement during the pivoting of the cover plate, and the pivot axis of the pivotal movement is parallel to a centerline of the pipe. In other words, a pivot axis may be added to one of the cover plates. For example, when the cover plates needs to be closed, one cover plate may be pivoted horizontally to a position overlapping with the other cover plate, and then the two overlapping cover plates may be pivoted together around an axis perpendicular to the centerline of the pipe.

The figure also shows a mounting frame 300 fixed on the pipe 200, and the driving device 2 of the rain cover assembly 100 is mounted on the mounting frame 300.

Figure 19:
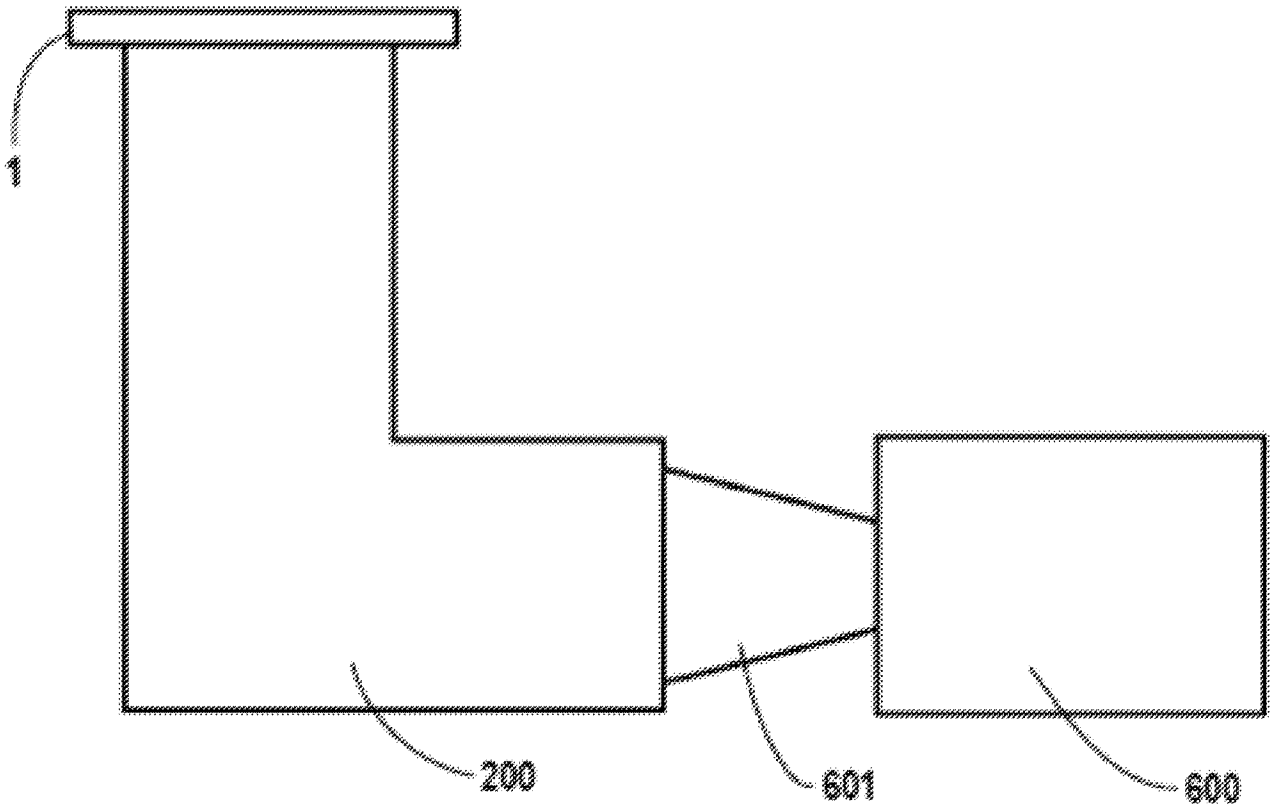
FIG. 19 is a schematic diagram of a connection state of a turbine engine, a diffuser duct and a pipe according to a preferred embodiment of the present disclosure.

In particular, the present disclosure further provides a turbine fracturing unit, which includes a turbine engine and an exhaust muffler mounted at the exhaust port of the turbine engine. The exhaust muffler may be the pipe 200 described in the above embodiment. Further, as shown in FIG. 19, the turbine fracturing unit includes a turbine engine and a tapered diffuser duct connected between the turbine engine and the pipe 200. The pipe 200 may be an L-shaped pipe. One section of the L-shaped pipe extends horizontally and the other section extends vertically. The cover plate 1 covers an opening at the top end of the vertically extending section. The setting of the L-shaped pipe enables exhaust gas to be discharged after passing by a 90° corner.

Figure 20:
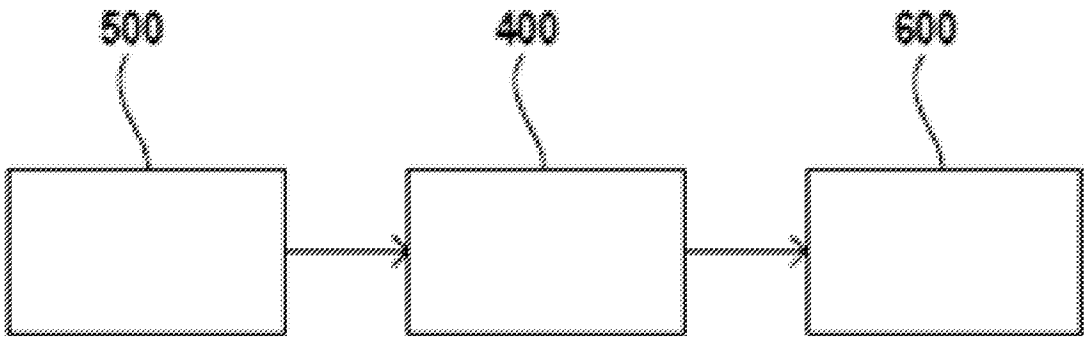
FIG. 20 is a diagram representing a communication relationship between a control device, a position sensor and a turbine engine according to a preferred embodiment of the present disclosure.

Referring FIG. 20, the turbine fracturing unit may further include a control device 400, and a position sensor 500 communicatively connected with the control device 400 is integrated in the power mechanism 21 of the rain cover assembly 100 on the exhaust muffler. The communication relationship among the control device 400, the position sensor 500, and the turbine engine 600 is shown in FIG. 14. The position sensor 500 is configured to sense the positional state of the cover plate 1 of the rain cover assembly 100 and send a sensing signal to the control device 400. For example, when the power mechanism 21 is a hydraulic cylinder, the position sensor 500 may be arranged adjacent to a piston or a piston rod in the hydraulic cylinder and can sense the displacement of the piston or piston rod. The control device 400 is configured to send a control signal to the turbine engine 600 when analyzing according to the received signal to determine that the cover plate 1 is at the closed position to disable the start of the turbine engine 600. In other words, the control device 400 allows the turbine engine 600 to be activated only when the cover plate 1 is at the open position; when the cover plate 1 is at the closed position, the turbine engine 600 cannot be activated, thereby improving the safety factor of the turbine fracturing unit.

According to the above solution, it may be understood that the rain cover assembly according to the present disclosure has at least two cover plate assemblies, which, when opened, will jointly form a closed additional pipe structure connected to the open end of the pipe to guide the exhaust gas of the pipe to a further space. Such an arrangement may reduce noise on the one hand, and prevent backflow of the exhaust gas on the other hand. The cover plates, when closed, can shield the opening of the pipe to prevent entry of rainwater.

The embodiments of this application are described above in combination with the accompanying drawings, but this application is not limited to the specific implementations described above. The foregoing specific implementations are only illustrative, not restrictive. Under the enlightenment of this application, those ordinary persons skilled in the art can also make many forms without departing from the scope protected by the purpose and claims of this application, all of which fall within the scope of protection of this application.

What is claimed is:

1. An exhaust apparatus of an engine, the engine being provided with a first exhaust outlet, wherein the exhaust apparatus comprises an exhaust muffler, a shroud plate and a cover plate, wherein:

the exhaust muffler is provided at the first exhaust outlet, and the exhaust muffler is provided with a second exhaust outlet, the shroud plate is provided at the second exhaust outlet, and the shroud plate is movably connected to the exhaust muffler, the shroud plate is movable between a first position and a second position relative to the exhaust muffler, and the cover plate is rotationally connected to the exhaust muffler to close or open the second exhaust outlet; and when the shroud plate moves to the first position relative to the exhaust muffler and the cover plate opens the second exhaust outlet, the shroud plate and the cover plate forming a heightening tube, the heightening tube communicating with the second exhaust outlet, and an upper port of the heightening tube being positionally higher than the second exhaust outlet.

2. The exhaust apparatus according to claim 1, wherein when the shroud plate moves to the first position relative to the exhaust muffler, a top surface of the shroud plate is flush with a top surface of the cover plate.

3. The exhaust apparatus according to claim 2, wherein:

the cover plate is movably connected to the shroud plate, and when the shroud plate moves, the cover plate is driven to rotate relative to the second exhaust outlet;

when the shroud plate moves to the first position relative to the exhaust muffler, the cover plate opens the second exhaust outlet; and when the shroud plate moves relative to the exhaust muffler to the second position, the cover plate closes the second exhaust outlet.

4. The exhaust apparatus according to claim 3, wherein the shroud plate is connected to the exhaust muffler in a sliding manner.

5. The exhaust apparatus according to claim 4, wherein the shroud plate is configured to sleeve over a duct of the exhaust muffler as it moves relative to the exhaust muffler.

6. The exhaust apparatus according to claim 5, wherein:

the exhaust apparatus further comprises at least one connecting rod, a first end of the at least one connecting rod being hinged with the cover plate, a second end of the at least one connecting rod being hinged with the shroud plate; and when the shroud plate slides relative to the exhaust muffler, the cover plate is driven by the at least one connecting rod to rotate relative to the second exhaust outlet.

7. The exhaust apparatus according to claim 6, wherein:

the shroud plate is a bent plate comprising a first enclosure portion, a second enclosure portion, and a third enclosure portion, the first enclosure portion, the second enclosure portion, the third enclosure portion, and the cover plate being sequentially connected in an end-to-end manner;

side edges of the cover plate comprise a left side edge and a right-side edge;

a number of the at least one connecting rod is at least two;

the first ends of two of the at least one connecting rod are hinged with the left side edge and the right-side edge; and the second ends of the two of the at least one connecting rods are hinged with the first enclosure portion and the third enclosure portion.

8. The exhaust apparatus according to claim 1, wherein:

the exhaust apparatus further comprises a limit sensor and an induction piece, one of the limit sensor and the induction piece being provided on the exhaust muffler, and the other one of the limit sensor and the induction piece being provided on the cover plate, and when the limit sensor detects that the induction piece moves to a preset position relative to the limit sensor, the engine is controlled to stop operation and/or the exhaust muffler is controlled to generate an alarm signal.

9. The exhaust apparatus according to claim 1, wherein:

the exhaust apparatus further comprises a guide mechanism, the guide mechanism comprising a guide rail and a sliding piece, one of the guide rail and the sliding piece being provided on the exhaust muffler, the other one of the guide rail and the sliding piece being provided on the shroud plate, and the guide rail being in sliding fit with the sliding piece; and a number of the guide mechanisms is at least two, and at least two of the guide mechanisms are provided on opposite sides of the exhaust muffler.

10. The exhaust apparatus according to claim 1, wherein the exhaust apparatus further comprises a drive mechanism, and the drive mechanism is connected to the shroud plate to drive the shroud plate to move relative to the exhaust muffler.

11. An engine, comprising the exhaust apparatus according to any one of claims 1 to 9.

12. A fracturing device, comprising the engine and the exhaust apparatus of claim 1.

* * * * *